US011564545B2

(12) United States Patent
Koura et al.

(10) Patent No.: US 11,564,545 B2
(45) Date of Patent: Jan. 31, 2023

(54) SELF-PROPELLED, DUST-COLLECTING ROBOT

(71) Applicant: MAKITA CORPORATION, Anjo (JP)

(72) Inventors: Kentaro Koura, Anjo (JP); Yasutoshi Shinma, Anjo (JP)

(73) Assignee: MAKITA CORPORATION, Anjo (JP)

( * ) Notice: Subject to any disclaimer, the term of this patent is extended or adjusted under 35 U.S.C. 154(b) by 908 days.

(21) Appl. No.: 16/423,339

(22) Filed: May 28, 2019

(65) Prior Publication Data

US 2019/0274507 A1 Sep. 12, 2019

Related U.S. Application Data

(63) Continuation of application No. 14/837,483, filed on Aug. 27, 2015, now Pat. No. 10,463,219.

(30) Foreign Application Priority Data

Oct. 3, 2014 (JP) ..... 2014-205005
Oct. 3, 2014 (JP) ..... 2014-205006

(51) Int. Cl.
*A47L 9/28* (2006.01)
*A47L 9/14* (2006.01)

(52) U.S. Cl.
CPC ..... *A47L 9/2884* (2013.01); *A47L 9/1418* (2013.01); *A47L 9/2868* (2013.01); *A47L 2201/00* (2013.01)

(58) Field of Classification Search
CPC ..... A47L 9/2868; A47L 9/2884
(Continued)

(56) References Cited

U.S. PATENT DOCUMENTS 5,109,566 A 5/1992 Kobayashi et al.
5,995,884 A 11/1999 Allen et al.
(Continued)

FOREIGN PATENT DOCUMENTS

DE 69910252 7/2004
DE 102005007923 A1 8/2006
(Continued)

OTHER PUBLICATIONS

Office Action from the German Patent & Trademark Office dated Jun. 7, 2019 in counterpart German patent applicatior No. 10 2015 011 905.2, including English translation thereof, examined claims 1-11 and English translation of the examined claims 1-11.
(Continued)

*Primary Examiner* — Michael D Jennings
*Assistant Examiner* — Aaron R McConnell
(74) *Attorney, Agent, or Firm* — J-Tek Law PLLC; Jeffrey D. Tekanic; Scott T. Wakeman

(57) ABSTRACT

A self-propelled, dust-collecting robot includes a main-body part including a dust collection box, and a first battery pack, which has a case, at least one battery cell in the case, a control circuit board having a controller mounted in the case, and a discharge terminal. The main body part includes a first battery pack mount having a connector to which the first battery pack is removably connectable. The first battery pack is configured for use in an electric power tool.

22 Claims, 17 Drawing Sheets

(58) Field of Classification Search
USPC ..... 15/319, 340.1, 340.3, 340.4
See application file for complete search history.

(56) References Cited

U.S. PATENT DOCUMENTS

| | | | | |
|---|---|---|---|---|
| 6,553,612 | B1 | 4/2003 | Dyson et al. | |
| 6,581,239 | B1 | 6/2003 | Dyson et al. | |
| 7,492,124 | B2 | 2/2009 | Johnson et al. | |
| 7,712,182 | B2 * | 5/2010 | Zeiler | H01M 50/284 15/353 |
| 7,769,490 | B2 | 8/2010 | Abramson et al. | |
| 7,979,954 | B2 * | 7/2011 | Moore | A47L 9/0045 15/352 |
| 9,532,688 | B1 | 1/2017 | Afrouzi et al. | |
| 2003/0060928 | A1 | 3/2003 | Abramson et al. | |
| 2003/0090234 | A1 * | 5/2003 | Glasgow | H02J 7/0045 320/107 |
| 2003/0117107 | A1 * | 6/2003 | Zick | H01M 50/267 320/112 |
| 2008/0052867 | A1 | 3/2008 | Park | |
| 2008/0062618 | A1 | 3/2008 | Frank et al. | |
| 2008/0276407 | A1 | 11/2008 | Schnittman et al. | |
| 2008/0281470 | A1 | 11/2008 | Gilbert et al. | |
| 2009/0307865 | A1 | 12/2009 | Williamson et al. | |
| 2010/0088843 | A1 | 4/2010 | Reed et al. | |
| 2010/0332067 | A1 * | 12/2010 | Abramson | A47L 9/0444 701/23 |
| 2011/0056177 | A1 * | 3/2011 | Goto | B62M 6/55 56/14.7 |
| 2012/0011668 | A1 | 1/2012 | Schnittman et al. | |
| 2012/0112689 | A1 | 5/2012 | Sever et al. | |
| 2012/0265343 | A1 | 10/2012 | Gilbert et al. | |
| 2013/0117952 | A1 | 5/2013 | Schnittman et al. | |
| 2015/0214758 | A1 | 7/2015 | Toya et al. | |
| 2015/0366133 | A1 | 12/2015 | Nojiri et al. | |

FOREIGN PATENT DOCUMENTS

| | | | |
|---|---|---|---|
| DE | 102010043582 | A1 | 5/2012 |
| DE | 102011004319 | A1 | 8/2012 |
| JP | S63311923 | A | 12/1988 |
| JP | H02241423 | A | 9/1990 |
| JP | H0453515 | A | 2/1992 |
| JP | H0588472 | U | 12/1993 |
| JP | H11285158 | A | 10/1999 |
| JP | 2002532178 | A | 10/2002 |
| JP | 2002360479 | A | 12/2002 |
| JP | 2002360480 | A | 12/2002 |
| JP | 2005313657 | A | 11/2005 |
| JP | 2006043302 | A | 2/2006 |
| JP | 2008155041 | A | 7/2008 |
| JP | 2013239259 | A | 11/2013 |
| JP | 2014030484 | A | 2/2014 |
| JP | 2014036750 | A | 2/2014 |
| JP | 2014083241 | A | 5/2014 |
| JP | 2014111190 | A | 6/2014 |
| JP | 2014147904 | A | 8/2014 |
| JP | 2014180501 | A | 9/2014 |
| WO | 0036962 | A1 | 6/2000 |
| WO | 0038255 | A1 | 6/2000 |
| WO | 2014021116 | A1 | 2/2014 |
| WO | 2014119160 | A1 | 8/2014 |
| WO | 2014119732 | A1 | 8/2014 |
| WO | 2014155904 | A1 | 10/2014 |

OTHER PUBLICATIONS

Summons to Attend Oral Hearing from the GPTO dated Oct. 25, 2019 in related DE application No. 10 2015 011 905.2, including translation thereof.
Trial and Appeal Decision from the JPO dated Sep. 30, 2019 in related JP application No. 2014-205005, including machine translation thereof.
Office Action from the JPO dated Oct. 15, 2019 in related JP application No. 2018-144105, including machine translation thereof.
Robot® Roomba® 400 Series Owner's manual having created date of Mar. 29, 2010.
Robot® Roomba® 500 Series Owner's manual having created date of Mar. 22, 2010.
Robot® Roomba® 600 Series Owner's manual having created date of Sep. 20, 2012.
Robot® Roomba® 700 Series Owner's manual having created date of Dec. 17, 2012.
Robot® Roomba® 800 Series Owner's manual having created date of Mar. 7, 2014.
Müheloses Gartnem (easy gardening), Bosch-Gartengerate 2013, Robert Bosch GmbH Power Tools, D-70745 Leinfelden Echterdingen (p. 69).
Office Action from the Chinese Patent Office dated Dec. 28, 2018 in counterpart Chinese application No. 201510632139, and machine translation thereof.
Office Action from the German Patent Office dated Nov. 2, 2017 in related German application No. 10 2015 011 905.2, and translation thereof.
Office Action from the Japanese Patent Office dated Oct. 31, 2017 in related Japanese application No. 2014-205005, and machine translation thereof.
Office Action from the Japanese Patent Office dated Oct. 31, 2017 in related Japanese application No. 2014-205006, and machine translation thereof.
Search Report from the Chinese Patent Office dated Dec. 20, 2018 in related Chinese application No. 201510632139, and machine translation thereof.
Search Report from the Japanese Patent Office dated Sep. 14, 2017 in related Japanese application No. 2014-205005, and machine translation thereof.
Search Report from the Japanese Patent Office dated Sep. 14, 2017 in related Japanese application No. 2014-205006, and machine translation thereof.

* cited by examiner

SELF-PROPELLED, DUST-COLLECTING ROBOT

CROSS-REFERENCE

The present application is a continuation application of U.S. application Ser. No. 14/837,483 filed on Aug. 27, 2015, now pending, which claims priority to Japanese patent application serial numbers 2014-205005 and 2014-205006, both filed on Oct. 3, 2014, the contents of which are incorporated fully herein by reference.

TECHNICAL FIELD

The present invention relates to a self-propelled, dust-collecting robot or autonomous floor cleaning robot powered by one or more rechargeable battery packs designed for power tools.

BACKGROUND ART

Self-propelled sweepers or robotic vacuum cleaners that collect dust from the surface of a floor are known and include a built-in motor that rotationally drives its wheels. As disclosed, for example, in Japanese Unexamined Utility Model Application Publication No. H5-88472, such a sweeper may comprise a rotary brush that is rotated by the drive of a motor and is disposed forward of a suction port. The sweeper gathers or sweeps up dust from the surface of the floor using the rotary brush.

SUMMARY OF THE INVENTION

Known self-propelled, dust-collecting robots, sweepers or floor cleaning robots typically have a power supply that is designed as a built-in, dedicated rechargeable battery. Such a design necessitates the preparation (design and manufacture) of batteries that differ by model, which incurs costs as well as time and labor to manage the variety of battery designs.

In addition, because known floor cleaning devices utilize only one battery (or one set of battery cells connected in series and/or in parallel), the continuous usage (run) time is relatively short, which means that the charging (recharging) frequency is high. Furthermore, the center of gravity is offset by the arrangement of the battery, and consequently some designs can not stably move (travel along the floor) during a floor cleaning operation.

Therefore, in one aspect of the present teachings, a self-propelled, dust-collecting robot or autonomous floor cleaning robot contains at least one rechargeable battery (battery pack) that is versatile and thereby does not incur costs or time and labor to manage a plurality of battery designs for different models of the robot.

In another aspect of the present teachings, a self-propelled, dust-collecting robot or autonomous floor cleaning robot may have a relatively long continuous usage time (run time), convenient handling (maneuverability) properties, and/or suitable stability while running (moving).

In another aspect of the present teachings, a self-propelled, dust-collecting robot is powered by a power tool battery pack that is configured or designed to supply electric power to a power tool such as, e.g., a driver-drill, an impact driver, a circular saw, a jig saw, an orbital sander, etc.

Because batteries (battery packs) designed for power tools can be used as the power supply, there is no need to prepare (design, manufacture) batteries that differ by model, which increases versatility and avoids costs and/or time and labor for battery management.

In addition or in the alternative, the following features may be utilized to achieve additional effects and/or advantages.

For example, a cover or cover body may be designed to be opened and simultaneously expose both the dust-collection box and the battery pack(s). In such an embodiment, the dust-collection box and the battery pack(s) can be put in (inserted or installed) and taken out (removed) with a single operation of the cover body, which increases convenience when performing maintenance on the robot.

The battery pack(s) and (a) mounting part(s) of the robot may be designed with engageable rails that extend vertically. In such an embodiment, the battery pack(s) can be easily mounted from above.

In some embodiments, the battery pack(s) can be disposed at the outermost part of the robot along the external shape (periphery) of the main-body part, and thereby the space inside the main-body part can be effectively utilized without creating any wasted space on the outer side of the battery pack(s).

The robot may be designed to be alternately powered by a plurality of battery packs. In such embodiments, the continuous run (usage) time may be increased, and the frequency of charging is reduced, thereby increasing convenience of operation. In addition, stability while running (traveling along the floor) is achieved.

In some embodiments, the two battery packs may be provided at the front or at the rear of the robot. Such a design utilizes an ideal number and arrangement of battery packs with regard to weight and balance while running (traveling along the floor).

In some embodiments, a notched part may be provided so that the rear part of the robot does not interfere with (contact) the floor surface when the front part of the main-body part is lifted up to move the dust-collecting robot (roll it along the floor), thereby making manual movement more convenient.

In some embodiments, the motor for driving a suction fan may be interposed between two battery packs, which provides a well balanced design.

DETAILED DESCRIPTION

Figure 1:
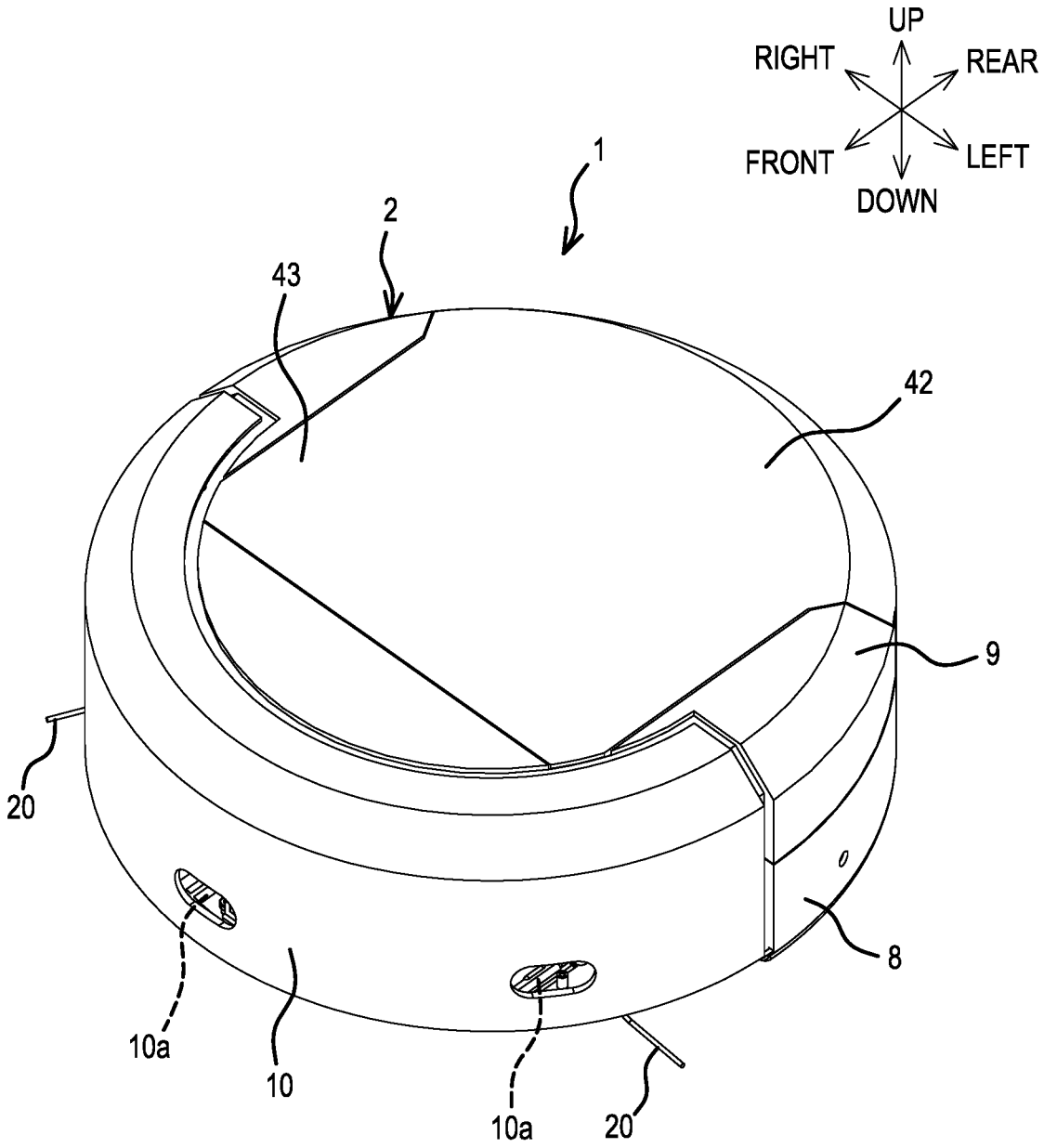
FIG. 1 is an oblique view of a self-propelled, dust-collecting robot as viewed from above.
Figure 2:
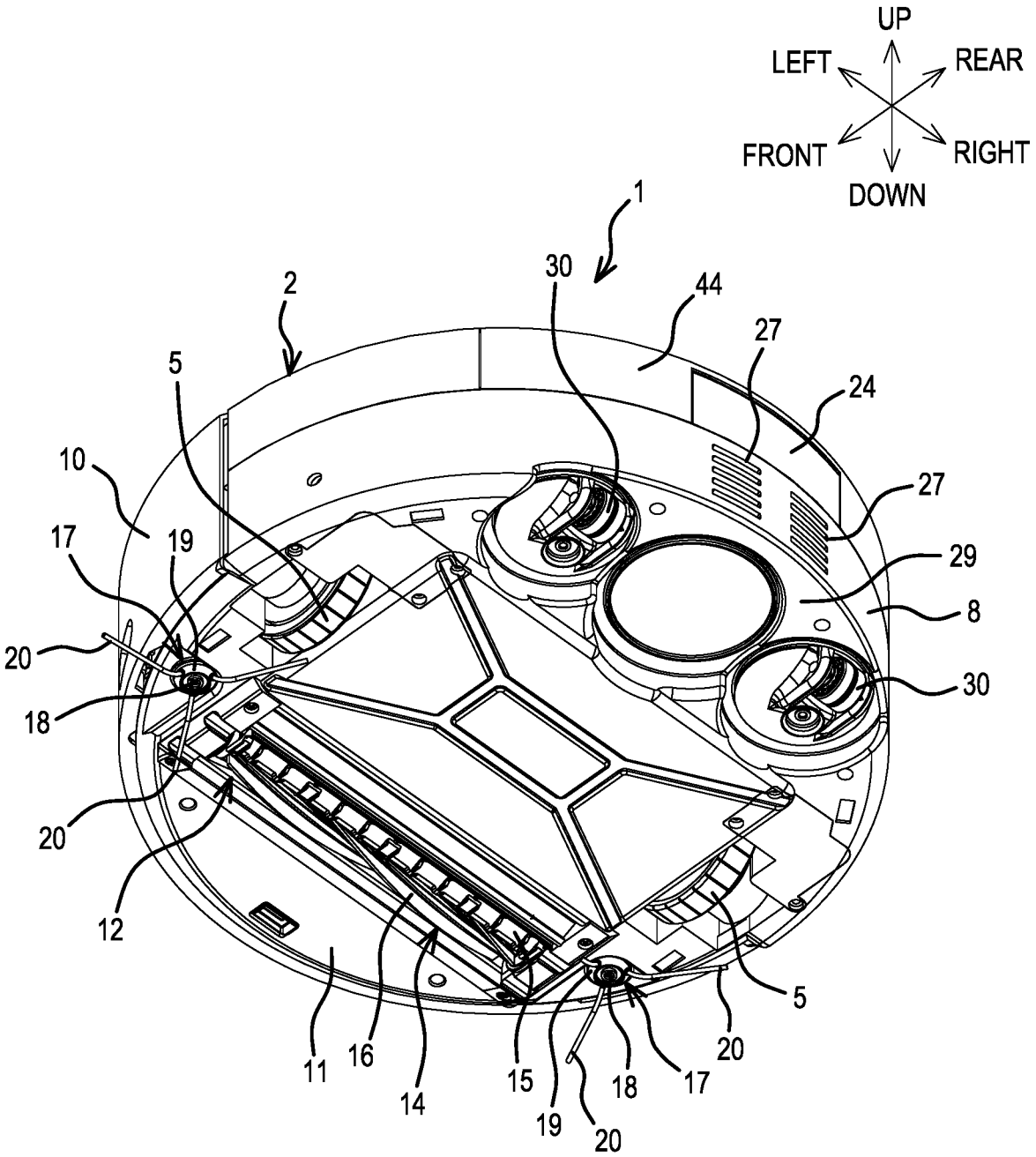
FIG. 2 is an oblique view of the self-propelled, dust-collecting robot as viewed from below.
Figure 3:
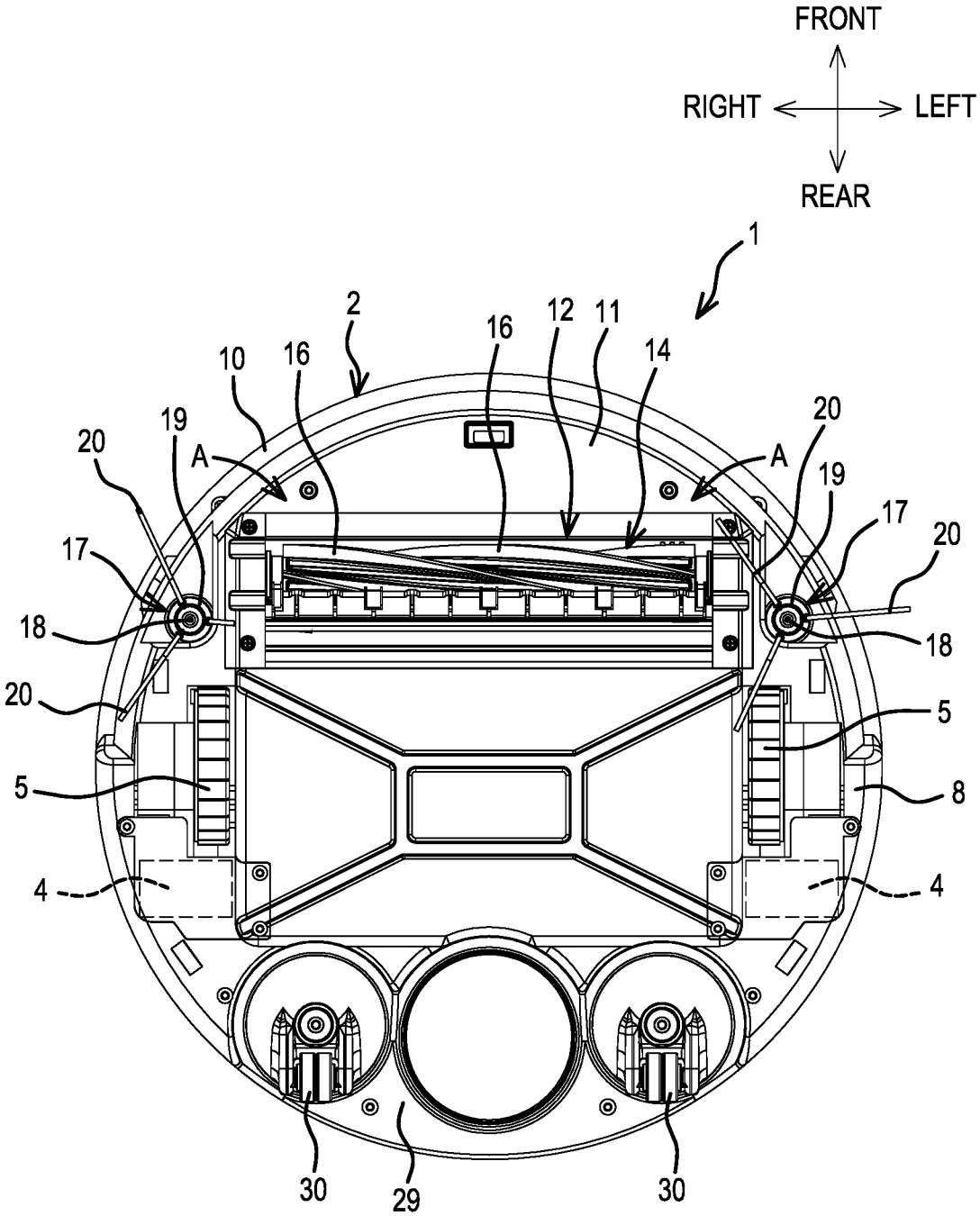
FIG. 3 is a bottom view of the self-propelled, dust-collecting robot.
Figure 4:
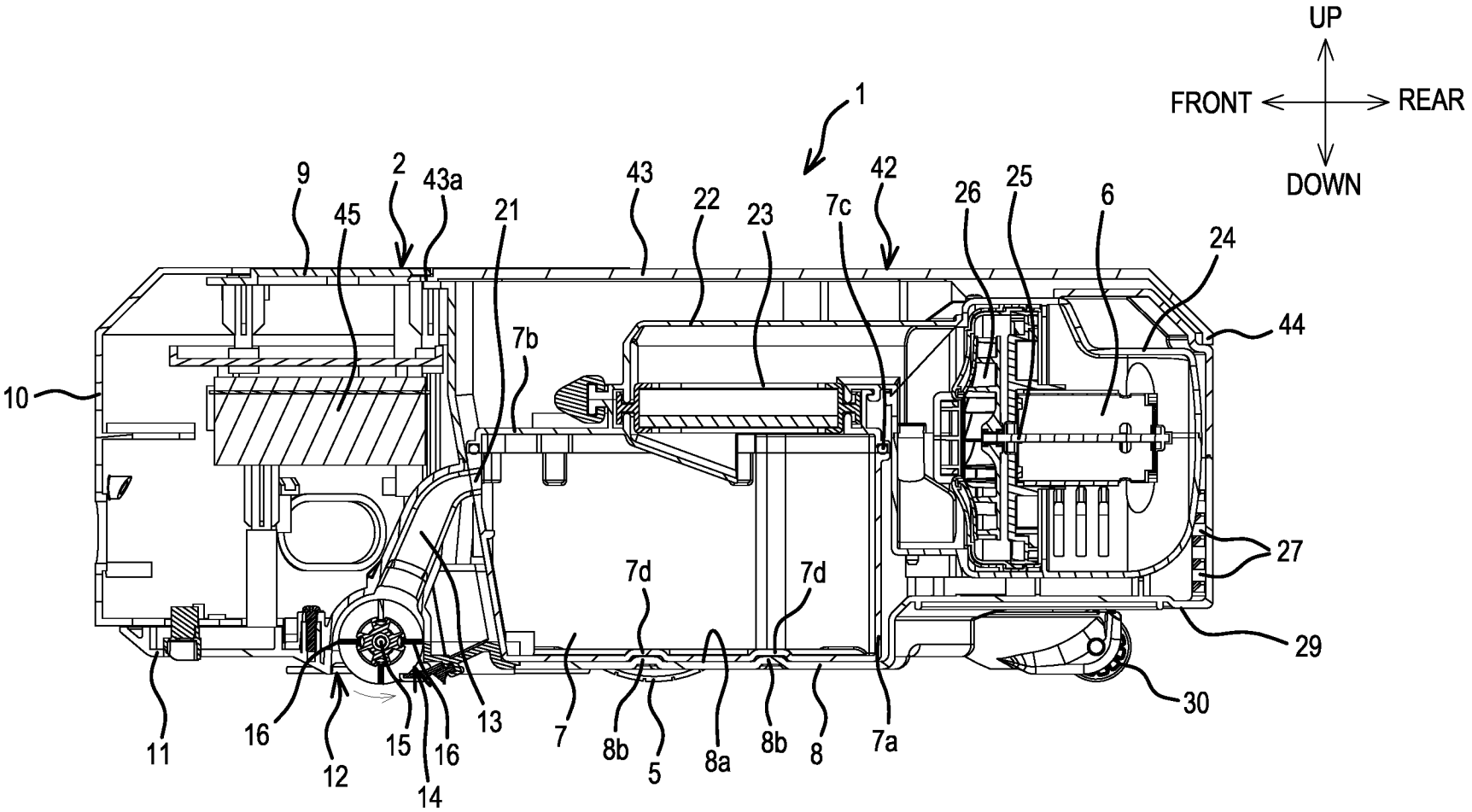
FIG. 4 is a center longitudinal-cross-sectional view of the self-propelled, dust-collecting robot.

As shown in FIGS. 1-5, a self-propelled, dust-collecting robot 1 (hereinbelow, simply called "dust-collecting robot") according to a first embodiment of the present teachings comprises, inside a main-body part (chassis) 2 that has a circular box (circular cylindrical) shape in plan view: left and right batteries (battery packs) 3; left and right electric motors 4, 4 that are respectively powered by the left and right batteries 3; a pair of left and right wheels 5, each of which can be independently rotated forwardly and reversely by its corresponding motor 4; a dust-collection motor 6 disposed between the batteries 3; and a dust-collection box 7. Lower portions of the wheels 5, 5 respectively protrude downward from (through) a bottom surface of the main-body part 2. The dust-collection motor 6 and the dust-collection box 7 constitute a dust-collection unit.

Dust-collecting robots 1 according to the present teachings are also known in the art as an autonomous floor-cleaning robot, autonomous floor cleaner, autonomous floor sweeper, vacuum cleaning robot, coverage robot, floor coverage robot, cleaning roller, roller cleaning system, robotic vacuum cleaner, robot cleaning system, etc. Generally speaking, these terms may be interchangeably used in the present teachings, although terms containing the word "vacuum" are typically only applicable to floor cleaning devices capable of generating a suction force in order draw (suck) in dust and dirt using a suction force.

The main-body part (chassis) 2 comprises a lower-side housing 8, which is formed (extends) from the bottom surface to a rear surface, and an upper-side housing 9, which is formed (extends) from an upper surface to a side surface. A plurality of sensors 10*a* are designed to contactlessly detect obstacles or objects in front of the robot 1 and are provided on an inner side of a front-part circumferential surface of the main-body part 2. Furthermore, a sensor cover 10 is movably mounted such that retracts (is pushed back relative to the housings 8, 9) when it contacts an obstacle (object) and thereby turns ON a not-shown switch.

A bottom-surface cover 11 has a rectangular suction port 12 that extends laterally in the left-right direction. The cover 11 is screw-fastened to the lower-side housing 8 at a front-side lower part of the main-body part 2. The suction port 12 communicates with a dust-collection path 13, which is provided above the lower-side housing 8 and rises diagonally toward its rear upper side. Inside the dust-collection path 13 are provided: a rotary shaft 15, which extends in the left-right direction, and a main brush 14, which comprises a plurality of brushes 16 embedded in the outer circumference thereof and extend radially and helically with respect to the rotational axis of the rotary shaft 15. The brushes 16 of the main brush 14 protrude downward from the suction port 12 and rotate, when rotationally driven by a motor (not shown), in the direction of the arrow shown in FIG. 4.

In addition, two side brushes 17 are respectively provided on the left and right of the suction port 12. Each of the side brushes 17 includes three brushes 20, 20 that are radially embedded in a lower end of a rotary shaft 18 and are joined to a discoidal (disk-shaped) brush base 19. The rotating inner side areas of brushes 20 overlap the suction port 12 in plan view and are designed to guide (sweep) dust towards the suction port 12. Each of the rotary shafts 18 passes through the bottom-surface cover 11 and is axially supported in the up-down direction. The side brushes 17 are respectively rotated by one or more motors (not shown) in the direction of arrows A shown in FIG. 3.

The dust-collection box 7 is divided into two parts, namely: a main body 7*a*, which is located on the lower side, and a cover 7*b*, which closes up the upper surface of the main body 7*a*. The main body 7*a* and the cover 7*b* are sealed along a sealing material 7*c*, such as a gasket or elastic ring. The dust-collection box 7 is set (designed) such that it can be mounted (inserted) in and removed from a housing part 8*a* formed at the center of the lower-side housing 8, and such that a forward inlet 21 formed (defined) in the main body 7*a* communicates with an outlet of the dust-collection path 13. Protruding parts 8*b* are formed in a bottom part of the housing part 8*a*, and recessed parts 7*d* are formed in a bottom part of the main body 7*a*. When the protruding parts 8*b* are respectively mated with the recessed parts 7*d*, the dust-collection box 7 is prevented from rattling during operation.

A filter box 22 comprises a filter 23 that can be attached to and detached from the upper surface of the dust-collection box 7. A motor box 24 is provided rearward of the filter box 22 and is disposed such that the motor box 24 communicates with the filter box 22. The dust-collection motor 6, which comprises a suction fan 26 located at a front end of an output shaft 25, is housed inside the motor box 24. Exhaust ports 27 communicate with the interior of the motor box 24 and are formed at the center of a rear surface of the lower-side housing 8.

Figure 5:
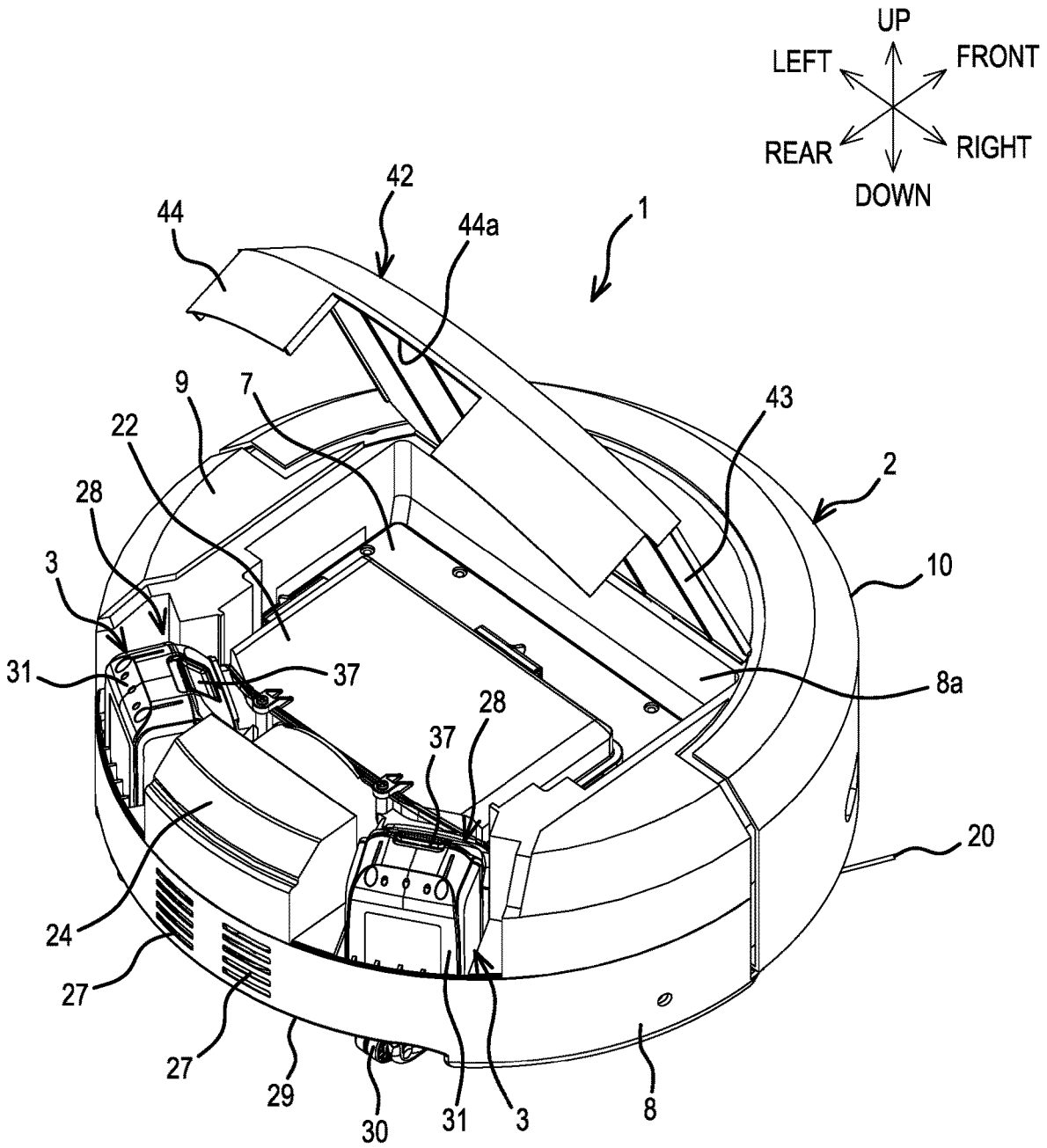
FIG. 5 is an oblique view of the self-propelled, dust-collecting robot with a cover body opened.
Figure 6A:
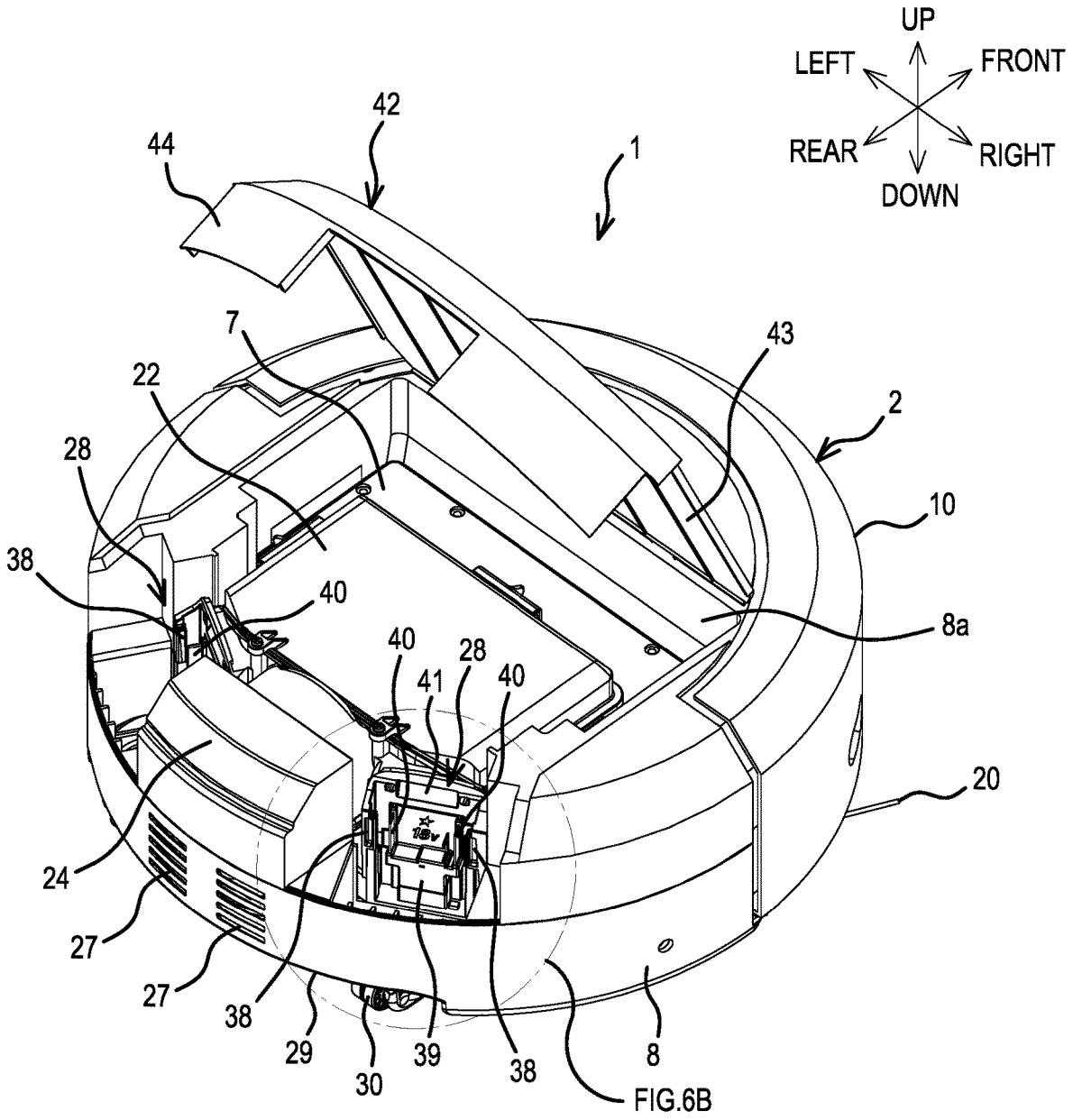
FIG. 6A is an oblique view of the self-propelled, dust-collecting robot with the cover body opened and the battery packs removed.
Figure 6B:
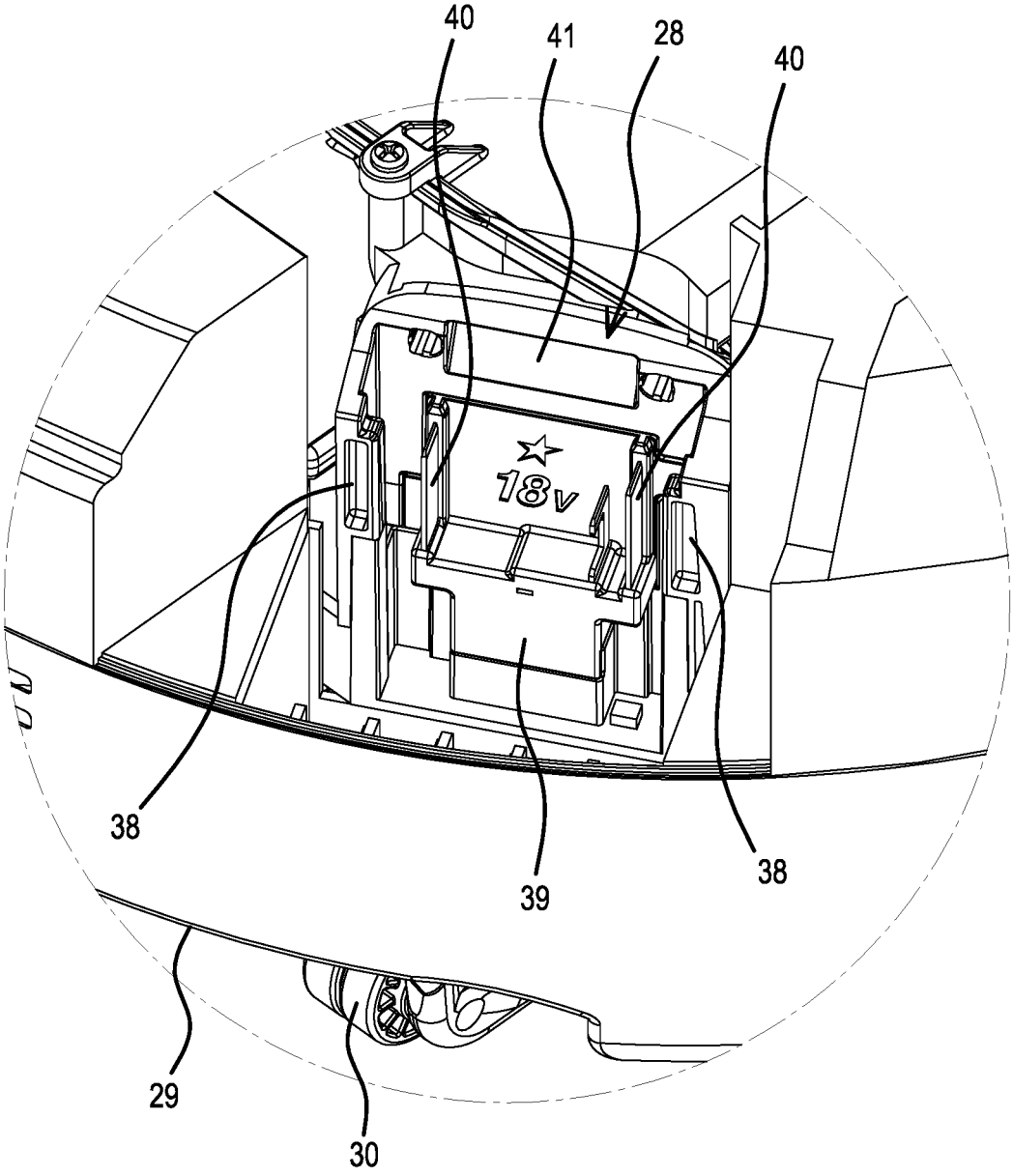
FIG. 6B is an enlarged view of a mounting part for the battery pack shown in FIG. 6A.
Figure 7:
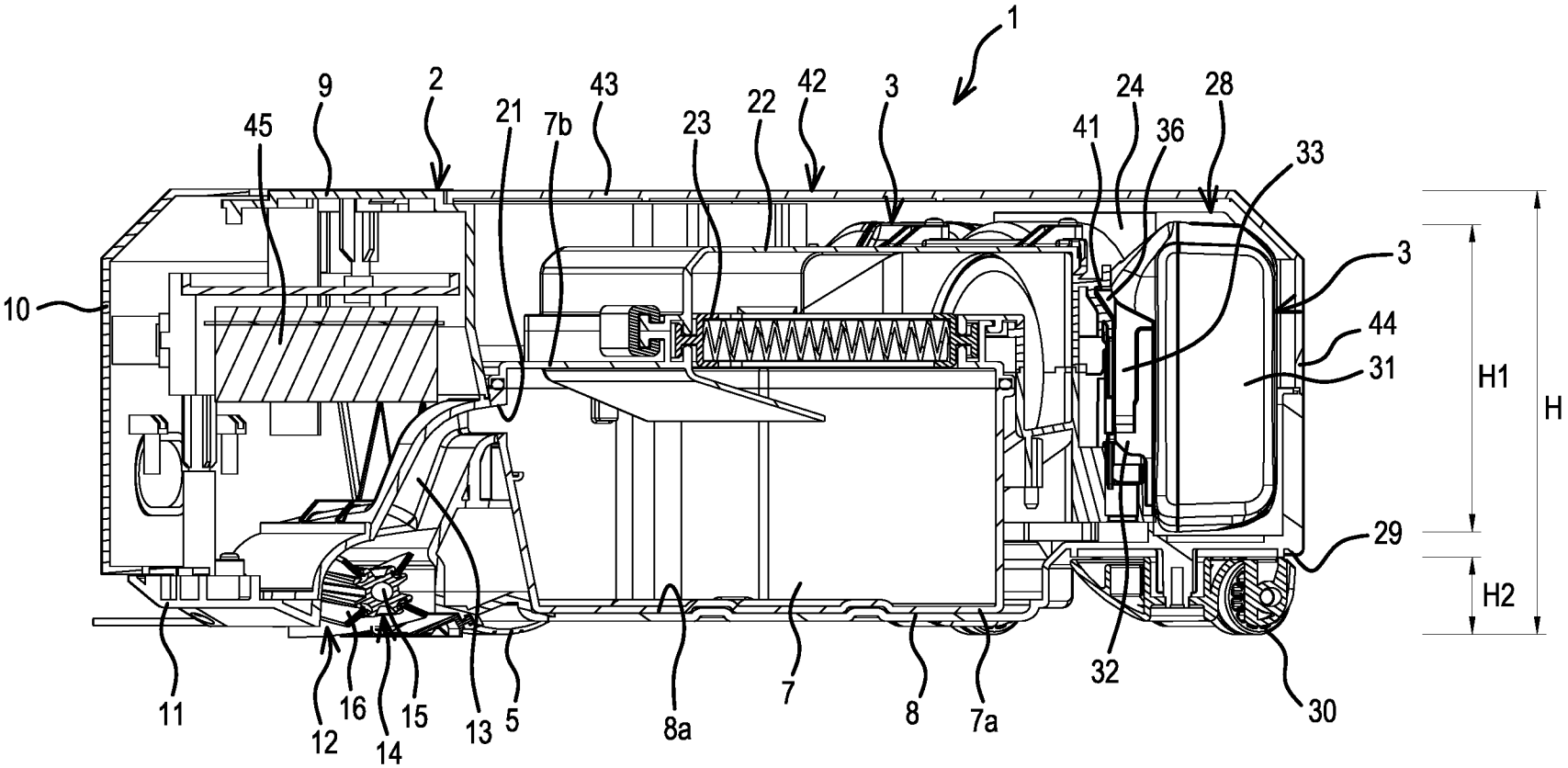
FIG. 7 is a longitudinal-cross-sectional view that exposes a portion of the self-propelled, dust-collecting robot containing one of the battery packs.

Referring now to FIGS. 5-7, two mounting parts 28, 28 for respectively holding the two batteries (battery packs) 3 are formed (defined) in/on the main-body part 2 on the left and right of the motor box 24, and rearward of the housing part 8*a*. The mounting parts 28 each have a bottomed hole shape (blind hole shape), such that they are open in the upward direction. The mounting parts 28 are disposed symmetrically (e.g., mirror symmetrically) on the left and right of a centerline extending in the front-rear direction of the main-body part 2. A notched part (notch) 29 is formed along the central, rear portion of the bottom surface of the lower-side housing 8. The bottom surface of the notch 29 is higher than the adjacent portions of the bottom surface of the lower-side housing 8. Two rotatable castors (pivotable wheels) 30 are respectively provided immediately below the mounting parts 28 and partially extend into the notched part (notch) 29. The castors 30, 30 are thus also disposed symmetrically (e.g., mirror symmetrically) on the left and right of the above-noted centerline that extends in the front-rear direction of the main-body part 2.

As used herein, the expression "immediately below" is intended to encompass embodiments, in which the entirety of each castor fits, in plan view, within the outer shape of its corresponding battery (battery pack), as well as embodiments, in which part or the entirety of each castor juts out (protrudes), in plan view, from the outer shape of its corresponding battery (battery pack), as long as the castor is positioned such that the load added to the main-body part centered on the battery (battery pack) can be supported.

Figure 8:
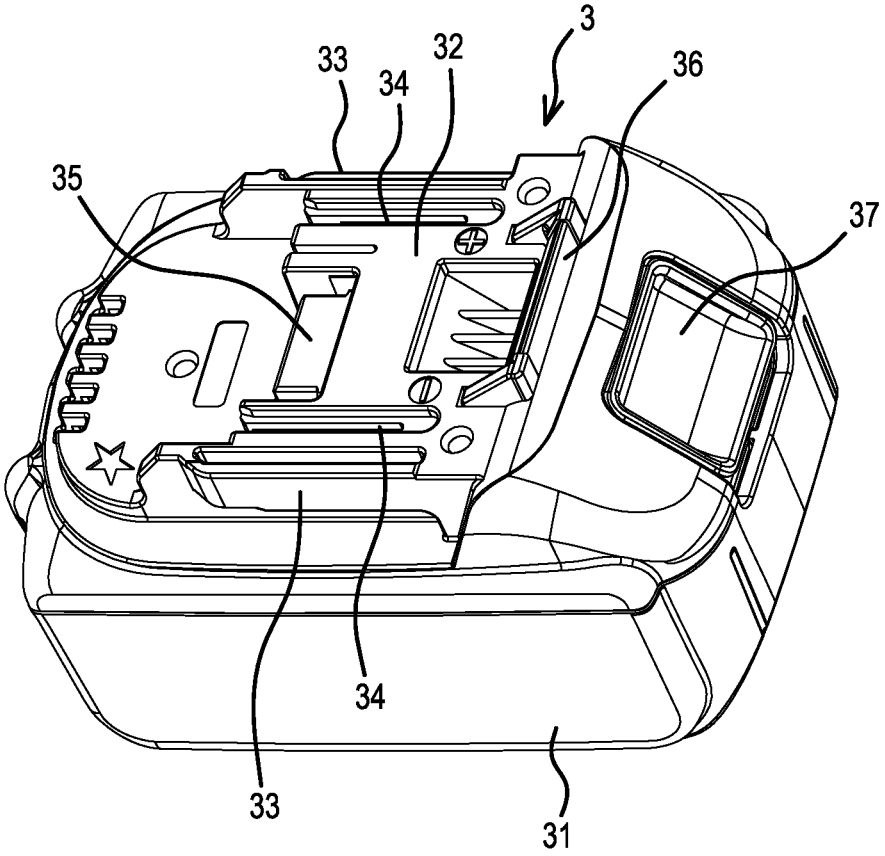
FIG. 8 is an oblique view of a representative rechargeable battery pack for use in the self-propelled, dust-collecting robot.
Figure 16:
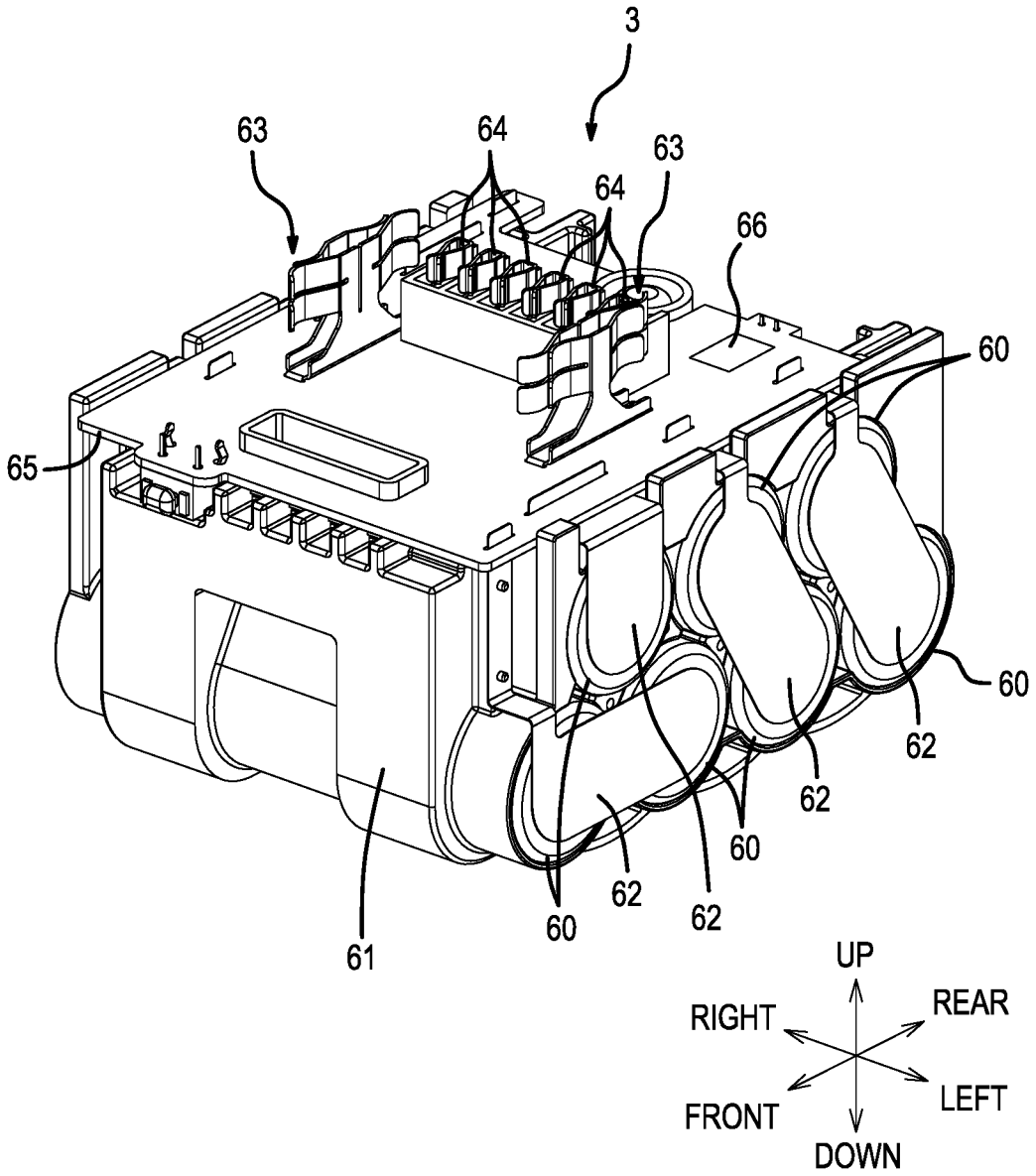
FIG. 16 is an internal view of the battery pack shown in FIG. 8.

The batteries (battery packs) 3 respectively mounted in the mounting parts 28 may preferably be lithium ion battery packs that have a nominal (rated) output voltage of 12-36 volts, preferably about 18 volts, and are also designed to be used as the detachable, rechargeable power supply for known power tools, such as driver-drills, impact drivers, circular saws, jig saws, orbital sanders, etc. FIG. 8 shows the external appearance of a representative battery pack 3 that may be used with dust-collecting robots 1 according to the present teachings. Referring to FIGS. 8 and 16, multiple (e.g., seven) rechargeable battery cells 60 are held by a cell holder 61 inside a case (lower side case) 31 having an oblong box shape and are connected in series by a plurality of lead plates 62 that connect opposite poles of the battery cells 60 to one another in a known manner. A coupling part (upper side case) 32 comprises a pair of rails 33, 33 extending in parallel on the left and right in the longitudinal direction. The coupling part 32 is formed or disposed on (fixedly attached to) an upper surface of the case 31. Plus and minus terminals 63 of the battery pack 3 are respectively disposed in two slits 34 that are configured face corresponding plus and minus terminals (plates) 40 (see FIG. 6B) disposed in the mounting parts 28. The slits 34 are provided parallel to the rails 33 and between the rails 33, 33 in the coupling part 32. A connector 35 containing signal terminals 64 designed for electrical communication, e.g., with a charger or a controller 45 of the robot 1 (see below), is provided between the slits 34. In addition, a hook 36 for coupling (latching) is provided on one end of the coupling part 32 in the longitudinal direction such that it protrudes and is urged (spring biased) upward. The hook 36 can be optionally retracted into the case 31 by a button 37, which is integral (fixedly connected) with the hook 36.

Furthermore, in addition to the battery cells 60, a thermistor (not shown) may be provided inside the case 31 and the thermistor may detect the temperature of a fuse, the battery cells 60, etc. within the battery pack 3, all of which are electrically connected to a control circuit board 65 provided inside the coupling part 32. One or more control devices 66, such as a microcontroller, a power FET, etc., is/are mounted on the control circuit board 65, and are designed to detect the temperature, the voltage, the electric current, etc. of the battery cells 60 and/or to control the supply of current from the battery cells 60 to the electrically-powered components of the robot 1. The control circuit (e.g., microprocessor) is further designed to stop discharging of the battery calls 60 by operating (opening or disconnecting) the power FET if an abnormality is detected during the discharging. The cell temperature information can be externally output via the connector 35.

Thus, the mounting parts 28 for holding (receiving) the batteries (battery packs) 3 have the same structure as the corresponding battery pack mounting parts provided on known power tools. That is, as shown in FIGS. 6A and 6B, two pairs of guide rails 38 respectively serve as engaging portions that are disposed laterally outwardly of, and mate with, the respective rails 33 of the coupling part 32 of the two batteries (battery packs) 3. The guide rails 38 are formed upward-facing (vertically extending) in the mounting parts 28 on an inner surface of the main-body part 2. Therefore, the batteries (battery packs) 3 can be respectively inserted into the mounting parts 28 along the guide rails 38 from the upper side. Between each pair of guide rails 38, 38, a terminal block 39 is provided so as to face upward and comprises the plus and minus terminals (plates) 40, 40 that are inserted into (disposed within) the corresponding slits 34 of the coupling part 32 when the corresponding battery pack 3 is inserted into the mounting part 28. The terminal block 39 may also include signal terminals (plates) that contact the corresponding signal terminals 64 of the battery pack 3 in embodiments in which the controller 45 of the robot 1 communicates with the microcontroller 66 of the battery pack 3, e.g., to communicate that the charge of one or both of the battery packs 3 has been depleted and the battery pack(s) 3 must be recharged. One or more indicators (e.g., LED(s), LCD(s), etc.) may be provided on the surface of the main-body part 2 or on a cover body (cover) 42 to provide a visual indication concerning the charge level of the battery packs 3. In addition or in the alternative, the controller 45 may be configured to generate an audio signal or sound to warn the user of the depleted battery pack(s) 3. In addition, a recessed part (recess) 41, which is designed to engage with the hook 36, is provided upward of each terminal block 39. That is, by engaging the retractable hook 36 in the recess 41, the battery pack 3 can thereby be securely latched in/to the mounting part 28 so that it does not move during operation.

Further description concerning battery packs that may be utilized with the present teachings are provided in US Patent Publication No. 2014/0302353, which is incorporated herein by reference in its entirety.

Each mounting part 28 has an inner surface that is tilted or angled from (relative to) the front-rear direction such that the inner surface of the mounting part 28, which includes the guide rails 38 and the terminal block 39, follows along (is generally parallel to) a tangential direction (tangent) of the outer circumference of the main-body part 2. That is, such angled inner surface extends in a horizontal plane at an angle to the front-rear centerline of the robot 1. The mounting part 28 is set (designed) such that, when the battery pack 3 is mounted therein, the coupling part 32 faces towards the center of the main-body part 2. By thusly tilting the battery packs 3 and mounting them radially with respect to the dust-collection box 7, the battery packs 3 can be disposed at the outermost part along the external shape (periphery) of the main-body part 2, and thus there is no wasted space on the outer side of the battery pack 3. That is, the bottom surface of the battery packs 3 may be nearly flush with the outer circumference of the lower housing part 8

Figure 9:
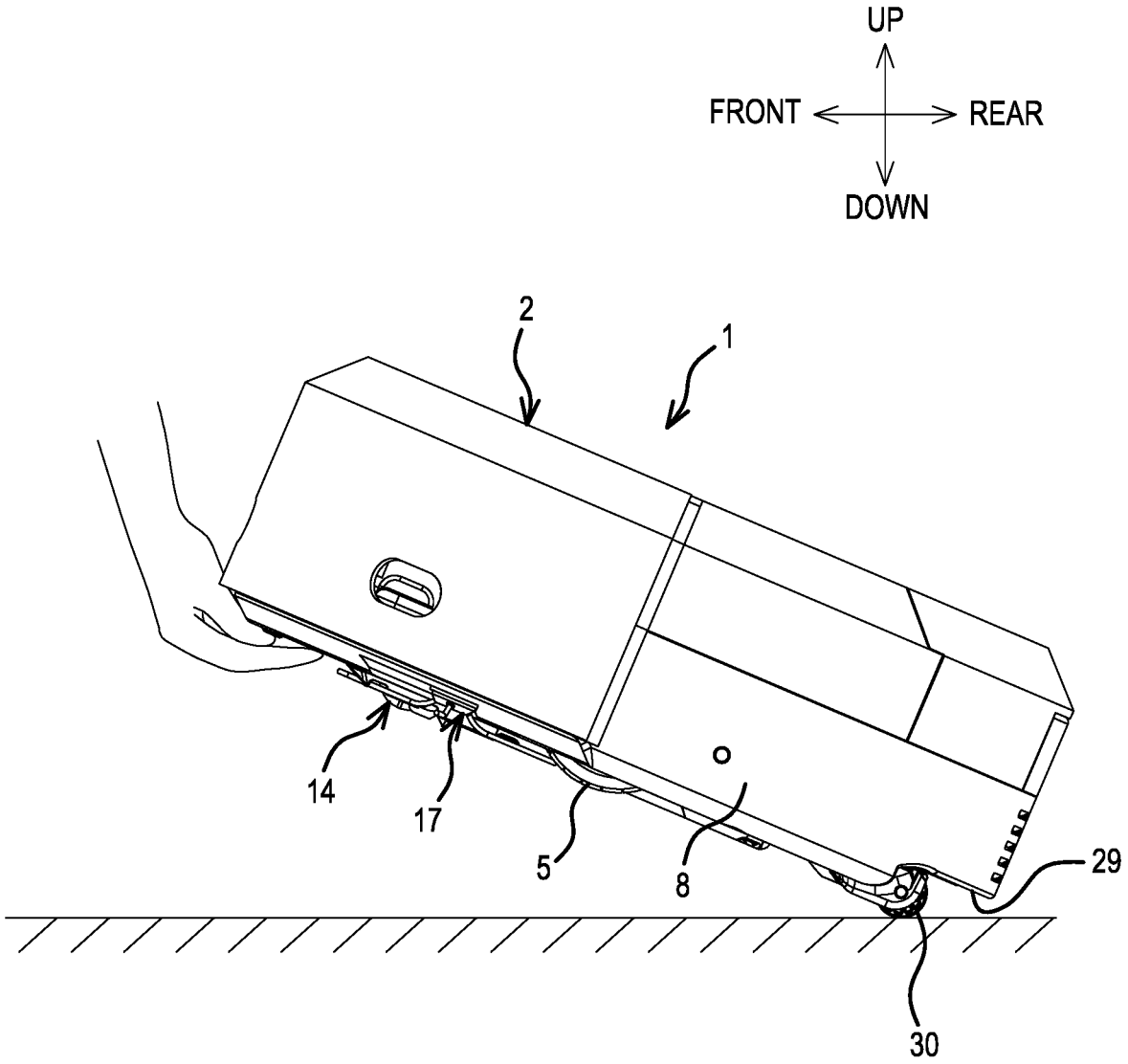
FIG. 9 shows a front end of the self-propelled, dust-collecting robot lifted (tilted) up to move the robot by rolling it on the floor using its castors.
Figure 10:
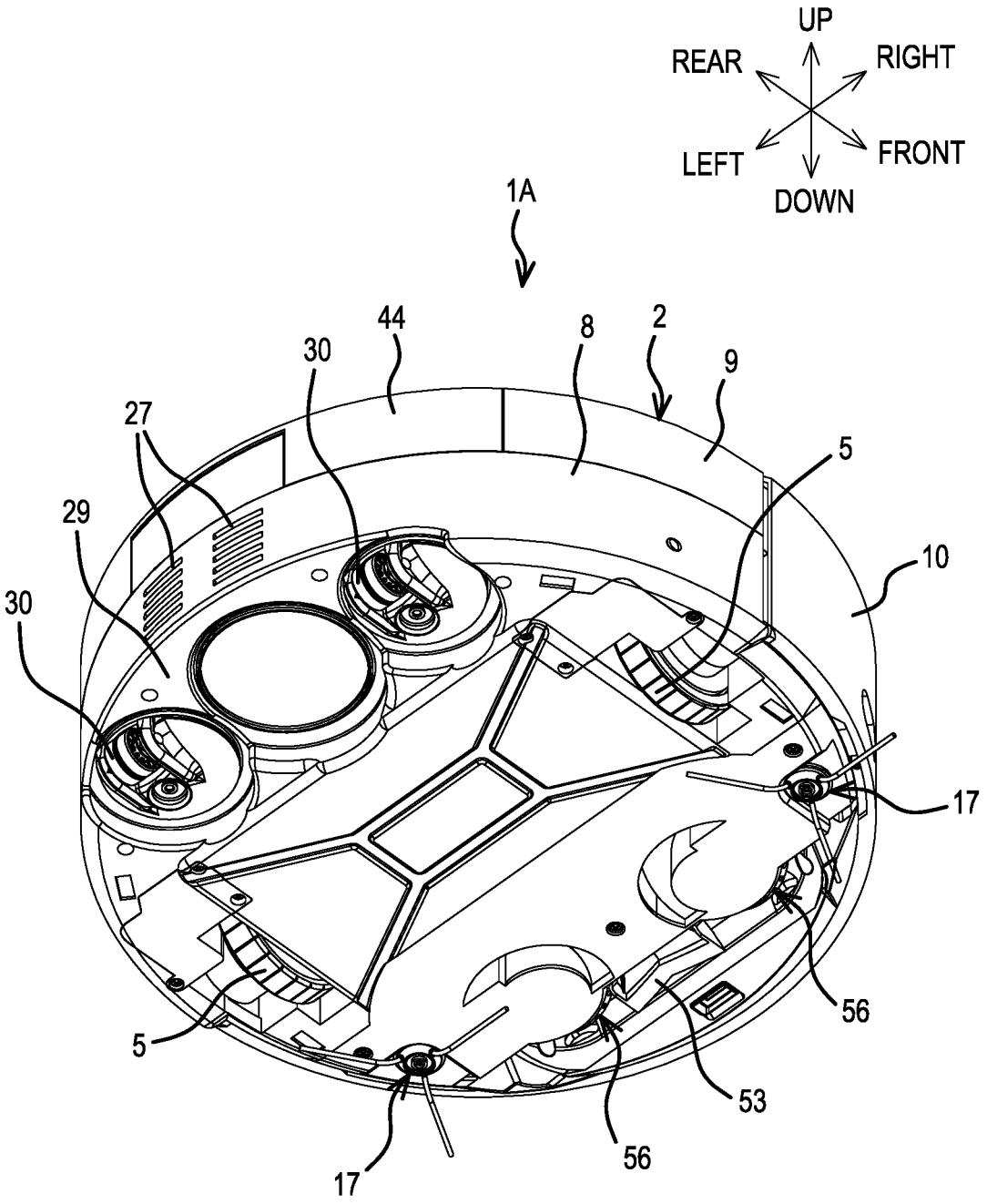
FIG. 10 is an oblique view of the self-propelled, dust-collecting robot, as viewed from below, according to a modified example.
Figure 11:
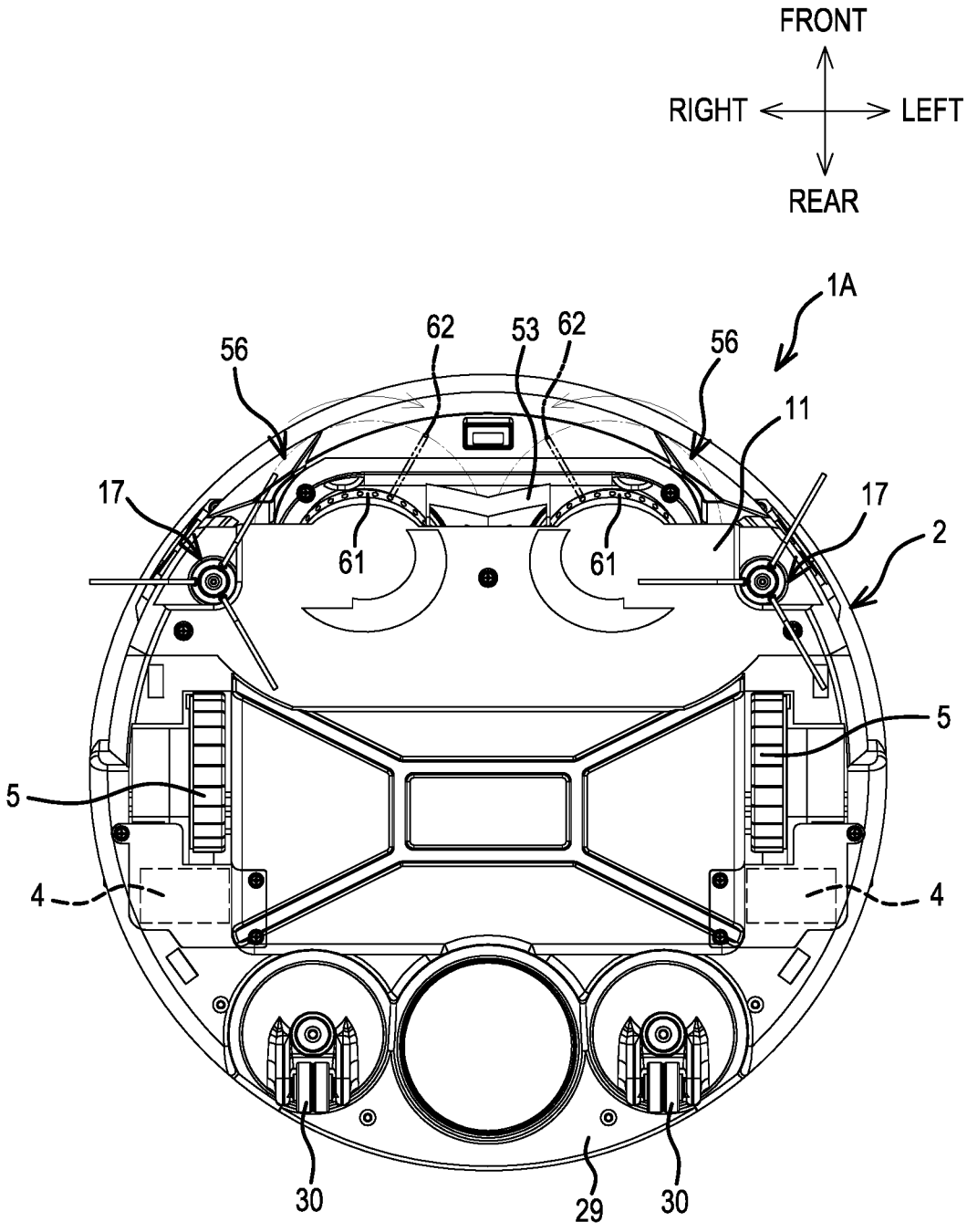
FIG. 11 is a bottom view of the self-propelled, dust-collecting robot according to the modified example.

Furthermore, because the two battery packs 3 are disposed with good left and right balance with respect to the centerline extending in the front-rear direction of the main-body part 2, a shifting of the center of gravity does not result even though two battery packs 3 are utilized. In particular, because the castors 30 are respectively located immediately below the mounted battery packs 3, 3, stability while running (moving along the floor) is good and tracking remains straight even if one of the battery packs 3 is not mounted (installed). In addition, when the front end of the main-body part 2 is lifted up by hand and the castors 30 contact the ground as shown in FIG. 9, the dust-collecting robot 1 can be moved by rolling it along the floor without having to be entirely lifted up. The notched part 29 prevents interference (contact) between the rear part of the main-body part 2 and the floor surface.

Furthermore, the cover body 42 is pivotably coupled to the upper-side housing 9 and opens (pivots) upward away from the housing part 8*a* and the mounting parts 28, 28. When the cover body 42 is pivoted upward, the dust-collection box 7 and the batteries 3 can be put in (inserted) and taken out (removed). The cover body 42 comprises an upper plate part 43 that covers, as viewed from above, an area that includes the area from the housing part 8*a* to the left and right mounting parts 28, 28. The cover body 42 further comprises two rear plate parts 44 that bend (project) downward from a rear-end edge of the upper plate part 43 and cover the rear part of the upper-side housing 9 including portions located rearward of the mounting parts 28, 28 on lateral sides of the motor box 24. A front end 43*a* (see FIG. 4) of the upper plate part 43 is connected via a hinge to a front-side upper end of the housing part 8*a*, and thereby the housing part 8*a* and the mounting parts 28 can be opened and closed (exposed and covered) simultaneously by pivoting the cover body 42 about the hinge located at the front end 43*a*. A notch 44*a* (see FIG. 5) is provided for preventing interference with the motor box 24 and is formed in the center of the rear plate part 44. A latching part (not shown) that latches with the lower-side housing 8 in the closed position is provided at the lower end of each of the rear plate parts 44.

It is noted that, as shown in FIG. 7, height H of the entire main-body part 2 is greater than the combined height of height H1 of the mounted batteries 3 and height H2 of the castors 30. Therefore the battery packs 3 do not protrude from (above) the upper surface of the main-body part 2. However, if the height H is intended to be less than the combined height of the height H1 of the battery packs 3 and the height H2 of the castors 30, then the battery packs 3 and the castors 30 may be positioned, partially or entirely, laterally offset from one another, in modified embodiments of the present teachings.

In the above-described dust-collecting robot 1, when the batteries (battery packs) 3 are mounted in their respective mounting parts 28 and the dust-collecting robot 1 is placed on the floor surface, the brushes 16 of the main brush 14 and the brushes 20 of the side brushes 17 each make contact with the floor surface. When a run (ON/OFF) switch disposed on an operation panel (not shown), which may be provided on the upper surface of the upper-side housing 9 or on the cover body 42, is pressed, the motors 4, 4 begin to run and rotationally drive the wheels 5. Then, the dust-collecting robot 1 travels on (along) the floor surface in accordance with one or more programs stored in the controller 45 (FIGS. 4, 7) located inside the main-body part 2. As will be discussed further below, the controller 45 may optionally comprise a central processing unit (CPU) that includes a microprocessor and memory that stores one or more operating programs to be executed by the microprocessor.

When the main brush 14 and the side brushes 17 rotate and the dust-collection motor 6 simultaneously rotationally drives (rotates) the suction fan 26, dust on the floor surface is brushed (swept) towards the dust-collection path 13 by the rotating main brush 14, is suctioned via the suction port 12 by the suction force produced by the suction fan 26, and is then conveyed to the rearward dust-collection box 7 via the dust-collection path 13. Large dust particles fall to the bottom of and accumulate in the dust-collection box 7, whereas small dust particles are trapped by the filter 23 because the suctioned-in air passes through the filter 23 (where the small particles are trapped), transits the motor box 24, and is discharged via the exhaust ports 27. At the same time, dust located laterally outward of the main body part 2 is also gathered (swept) towards the main brush 14 by the side brushes 17, which expand the range (span) over which dust can be collected and make it possible to collect dust even in corners or near walls.

In one embodiment of the present teachings, the batteries (battery packs) 3 disclosed herein may be configured (adapted) to be used (discharged) sequentially (i.e. one at a time) as the power supply, and the remaining charge (charge level) of each of the batteries 3 may be displayed by a display (e.g., an LCD or one or more LEDs) provided on the operation panel, as was mentioned above. In such an embodiment, if the charge of one of the batteries 3 runs out (is depleted) before the charge of the other, then the cover body 42 can be opened and the depleted (discharged) battery 3 can be removed from its mounting part 28 to be recharged by an external battery charger. In this case, the dust-collecting robot 1 can continue to run (operate) with just the other battery 3. Furthermore, because the castors 30 are provided in a left-right symmetrical manner as was discussed above, the dust-collecting robot 1 can travel (move along the floor) stably via the left and right castors 30 even if the center of gravity of the main-body part 2 shifts because only one of the batteries 3 is mounted (installed).

Thus, according to the dust-collecting robot 1 of the above-described embodiment, batteries (battery packs) 3 designed for power tools are used as the power supply, and consequently there is no need to prepare (design, manufacture) batteries that differ by model, versatility is improved, and neither costs nor time and labor for battery management are incurred.

In addition or in the alternative, each of the batteries (battery packs) 3 preferably comprises the case 31, the battery cells 60 built into (installed in) the case 31, the terminals 63 for discharging, and the control circuit board 65, which is built into the case 31 and monitors for any discharge errors. Therefore, the battery packs 3 can be reliably used as an excellent power supply.

In addition or in the alternative, because the main-body part 2 is provided with the cover body 42, which is capable of pivoting to expose both the dust-collection box 7 and the batteries 3 at the same time, the dust-collection box 7 and the batteries 3 can be put in (inserted) and taken out (removed) with a single operation of the cover body 42, which improves the convenience of operating and maintaining the robot 1.

In addition or in the alternative, because the batteries (battery packs) 3 are provided with the pair of rails 33 designed for coupling to a power tool and because the guide rails (engaging portion) 38, which are capable of coupling with the rails 33 from (along) the up-down direction, are formed in the mounting parts 28 of the main-body part 2, the batteries 3 can be easily mounted (inserted) from above.

Thus, because the guide rails 38 are provided, in plan view, on the outer side of the main-body part 2 in the radial direction thereof, the batteries 3 can be disposed at the outermost part along the external shape of the main-body part 2. Consequently, the space inside the main-body part 2 can be effectively utilized without wasting any space on the outer side of the batteries 3.

In addition or in the alternative, because two of the batteries (battery packs) 3 are provided, continuous use over a longer time becomes possible, the frequency of charging is reduced, and consequently convenience of use is greatly improved.

In addition or in the alternative, because the castors 30 are respectively disposed immediately below the batteries 3 (or preferably only partially laterally offset therefrom), the stability of operation (movement) is improved. In addition or in the alternative, two of the batteries 3 and two of the castors 30 are utilized, with one each on the left and right sides of a front-rear centerline, which is the ideal number and arrangement from the standpoint of weight and balance while running (moving along the floor).

In addition or in the alternative, by disposing the batteries 3 on the left and right of the dust-collection motor 6 such that they sandwich the dust-collection motor 6 (i.e. the dust-collection motor 6 is interposed between the batteries 3), a well-balanced arrangement is provided even though the dust-collection motor 6 is present.

In addition or in the alternative, because the notched part 29 is formed in the rear part of the main-body part 2 such that the rear part bottom surface is higher than the front part bottom surface of the main-body part 2, the rear part does not interfere with the floor surface when the front part of the main-body part 2 is lifted up to move the dust-collecting robot 1 as was discussed above, thereby increasing convenience when it is necessary to manually move the robot 1.

In the above-described embodiment, the rotation of the suction fan 26 produced by the dust-collection motor 6 generates a suction force that sucks in dust. However, in other embodiments of the present teachings, dust may be collected (drawn/swept into the robot 1) solely by the rotation of the main brush 14, the side brushes 17, etc., i.e. without provide such a motor, a fan, etc. for generating a suction (partial vacuum) force. In addition or in the alternative, the main brush 14 is not limited to one in which the rotary shaft is oriented in the left-right direction, and it is possible to configure the main brush 14 such that the rotary shaft is oriented in the up-down direction or is tilted, such as with a forward-tilted attitude, as will be further described in the following.

FIGS. 10-13 show a modified example of the present teachings, in which a suction fan is not used. In these Figures, any constituent elements that are identical to those in the preceding embodiment are assigned the same reference numerals, and redundant explanations are omitted.

In the dust-collecting robot 1A of the modified embodiment, a forward portion of a dust-collection box 50 in the lower-side housing 8 is designed as a rising (vertical) part 52, which rises upward along a front wall of the dust-collection box 50. Furthermore, an upper end of the rising part 52 reaches a receiving port 51 located in a front surface of the dust-collection box 50. A guide part 53, which tilts downward in the front direction, is continuous with an upper end of the rise part 52. A front end of the guide part 53 is formed into a V-shape in plan view, wherein the center of the front end is located closer to the rear side than the left and right ends are, which makes it easy to scoop (sweep) up dust into the guide part 53.

Moreover, a support plate 54 is attached inside the main-body part 2 above and parallel to the guide part 53. A dust-collection path 55, which has a tilted shape and connects from a lower surface of the main-body part 2 to the receiving port 51 of the dust-collection box 50, is formed between the support plate 54 and the guide part 53. Furthermore, a pair of main brushes 56, 56 is respectively provided on the left and right of the guide part 53. The main brushes 56 comprise a drive unit 57, which comprises a drive motor 58 and a reduction gear 59 that reduces the rotational speed of the motor shaft of the motor 58. Furthermore, in each main brush 56, a discoidal brush base 61, which has two or more brushes 62 embedded in a conical shape on the outer circumference thereof, is coupled to a rotary shaft 60, which protrudes downward from the reduction gear 59. The drive unit 57 is assembled (mounted) onto the upper side of the support plate 54, and the brush bases 61 are located downward of the support plate 54. In addition, downward of the brush bases 61, a drive pulley 63 is coaxially coupled to the rotary shaft 60.

Thus, the brush bases 61 of each main brush 56 have a forward-tilted attitude that is parallel to the guide part 53 because they are assembled (mounted) onto the tilted support plate 54. In addition, the brushes 62 of the left and right main brushes 56 are located at a spacing (are spaced apart) such that they overlap the guide part 53 in plan view, and the brushes 62 protrude diagonally downward from the dust-collection path 55. Furthermore, the main brushes 56 rotate in rotational directions opposite one another as indicated by the arrows shown in FIG. 11.

Furthermore, the side brushes 17 are provided on the bottom-surface cover 11 at both outer sides of the main brushes 56. The rotary shaft 18 of each of the side brushes 17 is provided with a follower pulley (not shown) on the upper side of the bottom-surface cover 11. The rotation of the rotary shaft 60 can be transmitted to the rotary shafts 18 via a belt (not shown), which is provided in a tensioned state between the follower pulleys and the drive pulley 63 provided on the rotary shaft 60 of the main brush 56.

Figure 14:
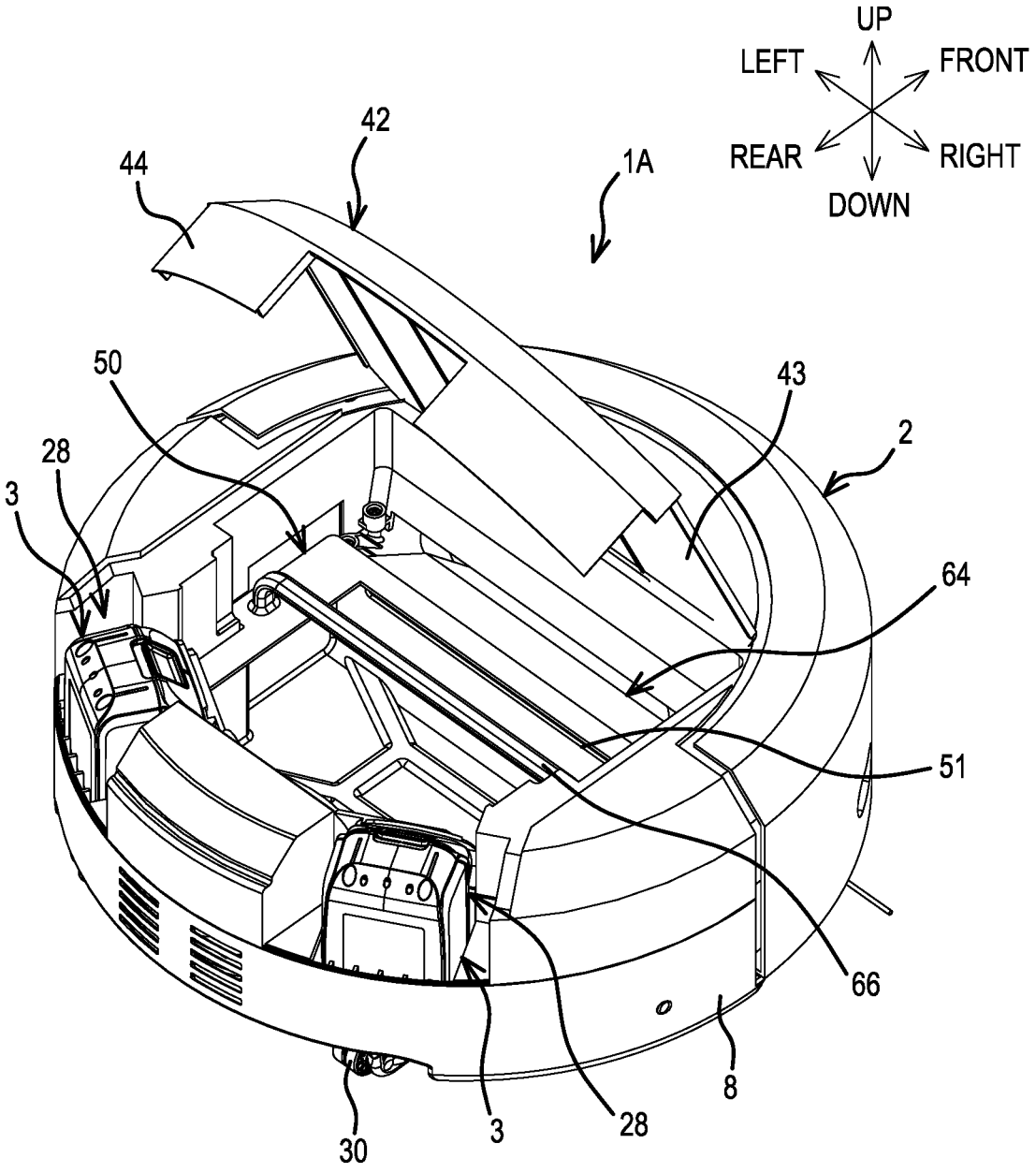
FIG. 14 is an oblique view showing the cover body of the self-propelled, dust-collecting robot according to the modified example in its opened position.
Figure 15:
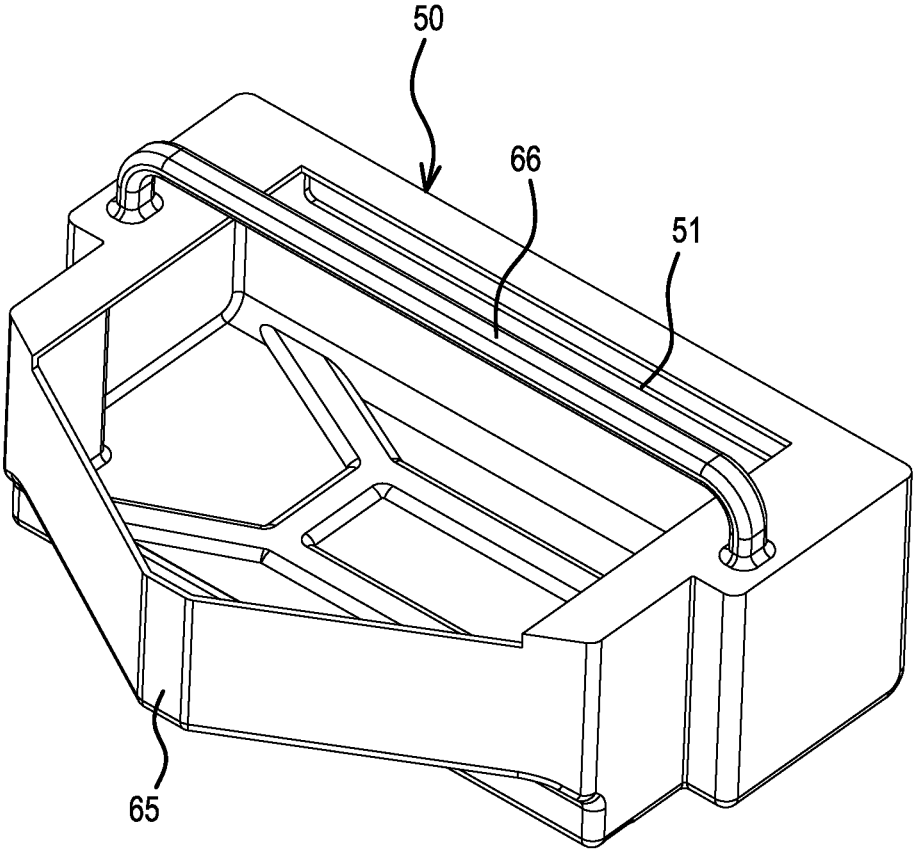
FIG. 15 is an oblique view of a dust-collection box.

Referring now to FIGS. 14 and 15, the removable dust-collection box 50 has a box shape whose upper surface is open. A housing part 64 of the main-body part 2 houses the dust-collection box 50 and is formed such that its length extends in the rearward direction to the point at which it abuts against the inner sides of the two mounting parts 28 and at a location at which the dust-collection motor 6 is not present. Thus a rear part of the housing part 64 has a mountain (peak or truncated triangle) shape that matches (is complementary to) the slanted portions (radially inner sides) of the mounting parts 28, 28 such that the center (in the left-right direction) protrudes most rearward, as shown in FIG. 14. Accordingly, as shown in FIG. 15, the dust-collection box 50 also has a corresponding (complementary) shape that matches the housing part 64, and a rear-end part 65 of the dust-collection box 50 fits in the mountain shape of the housing part 64. Consequently, when the dust-collection box 50 is removed to discard the accumulated dust, any such dust that has gathered in the mountain-shaped rear-end part 65 can be discharged from (poured out of) the tip without any scattering. A handle 66 optionally may be coupled to the upper side of the dust-collection box 50 for convenience in removing the dust-collection box 65 from the housing part 64.

Figure 12:
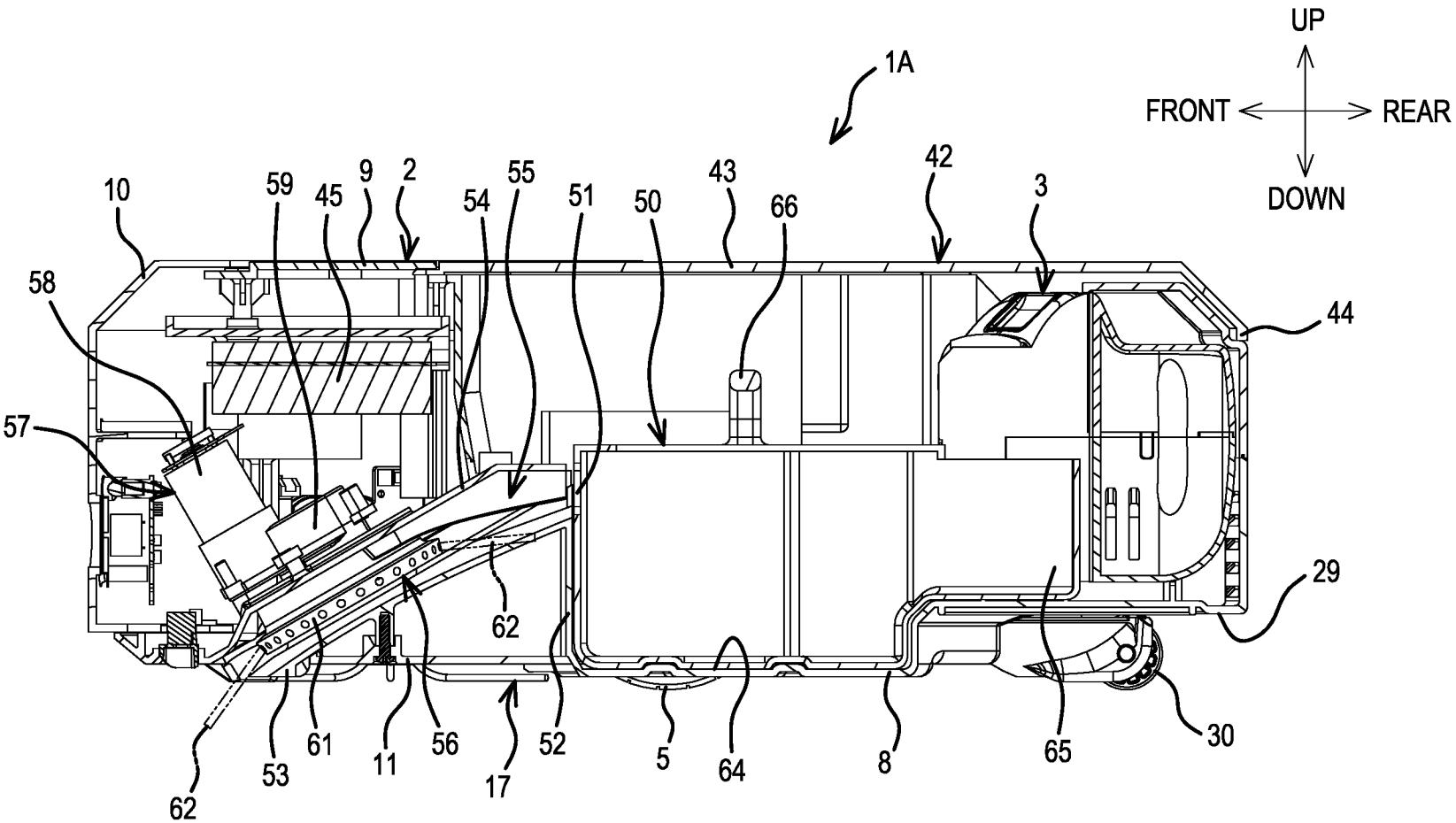
FIG. 12 is a center longitudinal-cross-sectional view of the self-propelled, dust-collecting robot according to the modified example.
Figure 13:
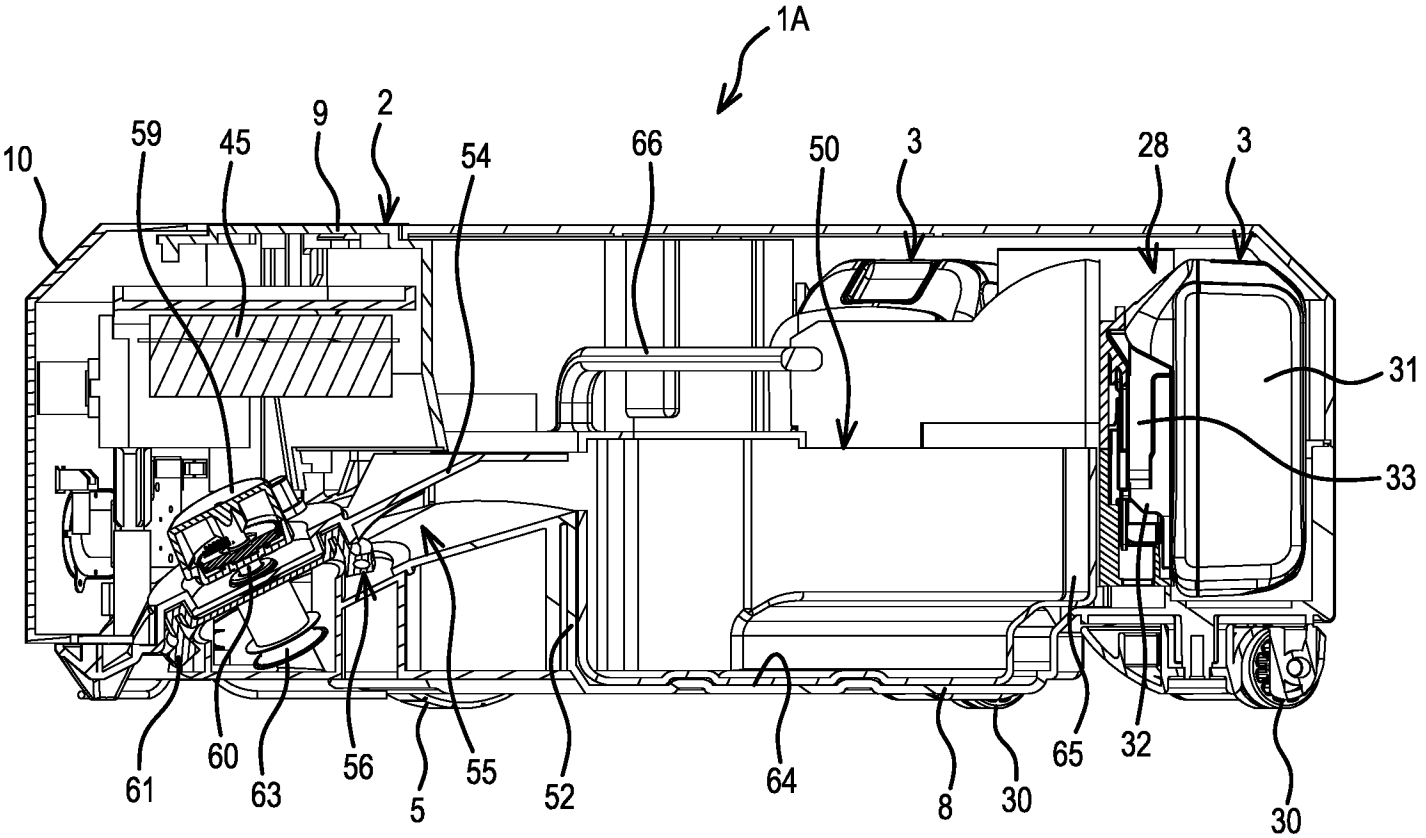
FIG. 13 is a longitudinal-cross-sectional view of the self-propelled, dust-collecting robot according to the modified example that shows the portion containing one of the battery packs.

Referring now to FIG. 12, when the above-described dust-collecting robot 1A is placed on the floor surface, the main brushes 56 have a forward-tilted attitude and are tilted at an angle with respect to the floor surface. Therefore, the brushes 62, which protrude forward from the dust-collection path 55, each make contact with the floor surface. When the run (ON/OFF) switch is pressed, the motors 4 operate and rotationally drive the wheels 5, and the dust-collecting robot 1 travels along the floor surface in accordance with its stored program. Simultaneously, the motor 58 of the drive unit 57 also operates to rotationally drive the main brushes 56. Furthermore, the side brushes 17 are also rotated, in the same directions as their corresponding main brushes 56, coupled via the belts. Therefore, the dust on the floor surface is collected and scooped (swept) up towards the guide part 53 at the center principally by the main brushes 56 and is transferred into the rearward dust-collection box 50 via the guide part 53.

In this manner, the dust-collecting robot 1A according to the above-mentioned modified example, which does not utilize a dust-collection motor (suction fan), likewise can use the batteries 3 designed for a power tool as the power supply. Consequently there is no need to prepare (design, manufacture) batteries that differ by model, versatility is improved, and costs and the time and labor of battery management are not incurred.

In all of the above-described embodiments and modified examples, two batteries (battery packs) 3 are utilized. However, in other aspects of the present teachings, it is also possible to use only one or three or more batteries (battery packs), as long as it/they is/are arranged with good left and right balance. In addition, the present teachings are equally applicable to robots in which the travel direction is the reverse of the above-described embodiments and modified examples. That is, the present teachings may be applied to self-propelled, dust-collecting robots wherein the batteries and the castors are located at the front part of the main-body part, and the suction port is located at the rear part of the main-body part.

In addition or in the alternative, the configuration of the batteries and the structure by which the batteries are mounted to the mounting parts likewise can be appropriately modified. For example, the battery (battery pack) can be designed to be inserted from the rear instead of from above. In addition or in the alternative, the engaging portions of the guide rails and the like can be provided in (on) the inner surface on the outer side in the radial direction instead of the inner surface on the inner side in the radial direction. In addition or in the alternative, the engaging portions can be provided on the inner surface along the radial direction. Furthermore, embodiments of the present teachings can also be designed such that the terminals contact one another by a simple plug-in structure instead of the rails and the guide rails that engage one another.

In addition or in the alternative, the batteries (battery packs) of the present teachings are not limited to batteries or battery packs designed to power a portable power tool that drives a tool accessory, such as a driver drill, a circular saw, a grinder, and an impact driver. The present teachings are also applicable to batteries or battery packs that are utilized with electrical equipment that does not employ a motor, such as a light, a lantern, a camera, a radio, a sensor, and the like, a tank-type dust collector with castors, such as a portable cleaner, a blower, or the like, and clothing, such as a heated jacket.

In addition or in the alternative, the number of castors is not limited to two, and it is also possible to use only one or three or more castors. Furthermore, the castors do not have to fit within the external shape (periphery) of the batteries in plan view as in the above-described embodiments. Instead, for example, the castors can also be arranged such that part or all of each castor juts out (protrudes or projects) from the external shape (periphery) of its corresponding battery in plan (top) view, as long as the castors are balanced on the left and right sides.

In addition or in the alternative, the cover body is not limited to a structure wherein the housing of the dust-collection box and the batteries open and close simultaneously. Instead, for example, it is also possible to provide separate cover bodies for the dust-collection box and the batteries.

In addition or in the alternative, to facilitate movement carried out by manually lifting up the front part of the main-body part, it is also possible (i) to form a hole, a recessed part, or the like in the lower surface of the main-body part that can be grasped with a finger, and/or (ii) to provide a grasping part, such as a band or a handle, in the upper surface of the main-body part, etc.

In the present teachings, the embodiments may alternately be referred to as an "autonomous robotic vacuum cleaner" or "autonomous robotic sweeper" or any of the other terms mentioned above.

Representative, non-limiting examples of the present invention were described above in detail with reference to the attached drawings, and additional examples are provided below. This detailed description is merely intended to teach a person of skill in the art further details for practicing preferred aspects of the present teachings and is not intended to limit the scope of the invention. Furthermore, each of the additional features and teachings disclosed above and below may be utilized separately or in conjunction with other features and teachings to provide improved self-propelled, dust-collecting robots, autonomous robotic vacuum cleaners, autonomous robotic sweepers, autonomous floor-cleaning robots, etc.

Moreover, combinations of features and steps disclosed in the above detailed description, as well as in the below additional examples, may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

Although the above-described embodiments primarily concern autonomous floor cleaning robots capable of sweeping and/or vacuuming dust/dirt, the present teachings are equally applicable to autonomous floor cleaning robots capable of scrubbing and/or mopping floors by providing the robot with one or more of a liquid-dispensing device, one or more scrubbers, one or more mopping cloths and/or one or more squeegees.

Although some aspects of the present invention have been described in the context of a device or apparatus, it is to be understood that these aspects also represent a description of a corresponding method, so that a block or a component of a device or apparatus is also understood as a corresponding method step or as a feature of a method step. In an analogous manner, aspects which have been described in the context of or as a method step also represent a description of a corresponding block or detail or feature of a corresponding device.

Depending on certain implementation requirements, components of the exemplary embodiments, such as the controller 45 of the robot 1 and/or the microcontroller 66 of the battery (battery pack) 3, may be implemented in hardware and/or in software. The implementation can be performed using a digital storage medium, for example one or more of a ROM, a RAM, a PROM, an EPROM, an EEPROM or a flash memory, on which electronically readable control signals (programs and stored values) are stored, which interact or can interact with a programmable hardware component such that the respective method is performed.

The programmable hardware component can be formed by or comprised of one or more of a processor, a computer processor (CPU=central processing unit), a graphics processor (GPU=graphics processing unit), a computer, a computer system, an application-specific integrated circuit (ASIC), an integrated circuit (IC), a system-on-a-chip (SOC), a programmable logic element, a field programmable gate array (FGPA) and/or a microprocessor.

The digital storage medium can therefore be machine- or computer readable. Some exemplary embodiments thus comprise a data carrier or non-transient computer readable medium which includes electronically readable control signals capable of interacting with a programmable computer system or a programmable hardware component such that one of the methods described herein is performed. An exemplary embodiment is thus a data carrier (or a digital storage medium or a non-transient computer-readable medium) on which the program(s) for performing one of the methods described herein is (are) recorded.

In general, exemplary embodiments of the present teachings may be implemented as a program, firmware, computer program, or computer program product including a program, or as data, wherein the program code or the data is operative to perform one of the methods if the program runs on a processor (e.g., a microprocessor) or other programmable hardware component. The program code or the data can for example also be stored on a machine-readable carrier or data carrier. The program code or the data can be, among other things, source code, machine code, bytecode or another intermediate code.

A further exemplary embodiment is a data stream, a signal sequence, or a sequence of signals which represents the program for performing one of the methods described herein. The data stream, the signal sequence, or the sequence of signals can for example be configured to be transferred via a data communications connection, for example via the Internet or another network. Exemplary embodiments are thus also signal sequences which represent data, which are intended for transmission via a network or a data communications connection, wherein the data represent the program.

A program according to an exemplary embodiment can implement one of the methods during its performance, for example, such that the program reads storage locations or writes one or more data elements into these storage locations, wherein switching operations or other operations are induced in transistor structures, in amplifier structures, or in other electrical, optical, magnetic components, or components based on another functional principle. Correspondingly, data, values, sensor values, or other program information can be captured, determined, or measured by reading a storage location. By reading one or more storage locations, a program can therefore capture, determine or measure sizes, values, variable, and other information, as well as cause, induce, or perform an action by writing in one or more storage locations, as well as control other apparatuses, machines, and components, and thus for example also perform complex processes using displays, projectors, etc.

Additional embodiments of the present teachings include, but are not limited to:

1. A self-propelled, dust-collecting robot operable by a power tool battery capable of supplying electric power to a power tool.

2. A self-propelled, dust-collecting robot, comprising a main-body part comprising a dust-collection box; and a battery capable of being mounted in and removed from the main-body part, wherein the battery comprises a case, one or more battery cell built into the case, a discharge terminal, and a control circuit board that is built into the case and monitors for discharge abnormalities.

3. The self-propelled, dust-collecting robot according to above-mentioned embodiment 2, wherein a cover body, which is capable of simultaneously exposing the dust-collection box and the battery, is provided on the main-body part.

4. The self-propelled, dust-collecting robot according to above-mentioned embodiment 1 or 2, wherein the battery is provided with a pair of rails for coupling to a power tool; and an engaging portion, to which the rails can couple from an up-down direction, is formed on the main-body part.

5. The self-propelled, dust-collecting robot according to above-mentioned embodiment 4, wherein the engaging portion is provided such that, in plan view, it faces the outer side of the main-body part.

6. The self-propelled, dust-collecting robot according to any of the above-mentioned embodiments, wherein a plurality of the batteries is provided.

7. A battery capable of being used in a self-propelled, dust-collecting robot, a portable cleaner, and a tank-type dust collector with castors.

8. A battery capable of being used in a self-propelled, dust-collecting robot, a power tool that drives a tool accessory using a motor, and electrical equipment wherein a motor is not used.

9. A self-propelled, dust-collecting robot, comprising a main-body part; a dust-collection unit provided on the main-body part; and a plurality of batteries disposed inside the main-body part.

10. A self-propelled, dust-collecting robot, comprising a main-body part; a dust-collection unit provided on the main-body part; a battery disposed inside the main-body part; and a castor provided in a lower part of the main-body part, wherein the castor is disposed immediately below the battery.

11. The self-propelled, dust-collecting robot according to above-mentioned embodiment 10, wherein two of the batteries are disposed in the main-body part, either at a rear part or at a front part of the main-body part, and each of the batteries houses a plurality of cells inside a case; and two of the castors are disposed in the main-body part, either at the rear part or at the front part of the main-body part.

12. The self-propelled, dust-collecting robot according to above-mentioned embodiment 10 or 11, wherein a notched part, the rear part bottom surface of which is higher than the bottom surface of the front part of the main-body part, is formed in the rear part of the main-body part.

13. The self-propelled, dust-collecting robot according to any of the above-mentioned embodiments 9-12, wherein the dust-collection unit comprises a dust-collection motor; and the batteries are disposed such that they sandwich the dust-collection motor on the left and right thereof.

14. A self-propelled, dust-collecting robot, comprising a main-body part; a dust-collection unit provided in the main-body part; a battery disposed inside the main-body part; and a plurality of castors provided in the lower part of the main-body part.

EXPLANATION OF THE REFERENCE NUMBERS

1, 1A Self-propelled, dust-collecting robot
2 Main-body part (chassis)

3 Battery (battery pack)
4 Motor
5 Wheel
6 Dust-collection motor
7, 50 Dust-collection box
8 Lower-side housing
8*a*, 64 Housing part
8 Lower-side housing
9 Upper-side housing
12 Suction port
13, 55 Dust-collection path
14, 56 Main brushes
15, 18 Rotary shafts
17 Side brush
24 Motor box
26 Suction fan
27 Exhaust port
28 Mounting part
30 Castor
31 Case
32 Coupling part
33 Rail
38 Guide rail
39 Terminal block
40 Terminal plate
42 Cover body
43 Upper plate part
44 Rear-plate part
45 Controller
53 Guide part
57 Drive unit
60 Battery cell
61 Battery cell holder
62 Lead plate
63 Plus/minus terminal
64 Signal terminals
65 Circuit board
66 Microcontroller

We claim:

1. A self-propelled, dust-collecting robot, comprising:

a main-body part including a bottom wall, a dust collection box, and a front wall portion spaced from a rear wall portion in a first direction;

a first battery pack having a case, at least one battery cell in the case, a control circuit board having a controller mounted in the case, and a discharge terminal;

a first drive wheel;

a second drive wheel spaced from the first drive wheel in a second direction perpendicular to the first direction, the first drive wheel and the second drive wheel being supported by the main-body part and being rotatable around a drive wheel axis of rotation;

a first castor and a second castor disposed between the drive wheel axis of rotation and the rear wall portion, each of the first and second castors respectively including a castor wheel rotatable about an axle axis of an axle and a support shaft attached to the housing and defining a pivot axis substantially perpendicular to the axle axis, each of the castor wheels being pivotable about the respective pivot axis; and a dust-collecting opening extending through the bottom wall between the drive wheel axis of rotation and the front wall portion;

wherein:

the main body part includes a first battery pack mount having a connector to which the first battery pack is removably connectable, the first battery pack is configured for use in an electric power tool, the first drive wheel is bounded by a first plane perpendicular to the drive wheel axis of rotation, the second drive wheel is bounded by a second plane perpendicular to the drive wheel axis of rotation, the pivot axis of the first castor and the pivot axis of the second castor are located between the first plane and the second plane, the first castor and the second castor are spaced from the dust-collecting opening in a direction opposite the first direction, the first castor is spaced from the second castor in the second direction, and the first battery pack does not overlie the drive wheel axis of rotation when the first and second drive wheels and the first and second castors support the robot on a support surface.

2. The self-propelled dust-collecting robot according to claim 1, wherein:

the first battery pack mount includes a vertical wall, the connector is located on the vertical wall and the first battery pack is configured to connect to the connector via movement in a first vertical direction and to disconnect from the connector via a movement in second vertical direction opposite the first vertical direction.

3. The self-propelled dust-collecting robot according to claim 1, wherein:

the main body part has a substantially cylindrical outer wall;

the first battery pack mount includes a first electrical terminal and a second electrical terminal separated by a gap, and a radius of the cylindrical outer wall passes through the gap without intersecting the first or second electrical terminal.

4. The self-propelled dust-collecting robot according to claim 3, wherein:

the first battery pack mount includes a first guide rail and a second guide rail, and the radius of the cylindrical outer wall passes between the first and second guide rails without intersecting the first or second guide rails.

5. The self-propelled dust-collecting robot according to claim 4, wherein the first and second electrical terminals are located between the first and second guide rails.

6. The self-propelled dust-collecting robot according to claim 5, further including:

a second battery pack mount configured in a manner identical to the first battery pack mount and a second battery pack connected to the second battery pack mount.

7. The self-propelled dust-collecting robot according to claim 6, wherein the first and second battery packs are externally mounted on the main body part.

8. The self-propelled dust-collecting robot according to claim 6, wherein the main body part has an interior;

wherein the dust-collecting robot further includes:

a vacuum unit having a dust-collection motor in the interior and connected to the dust-collecting opening and configured to draw dust into the dust-collecting opening; and wherein at least a portion of the first castor is located directly beneath the first battery pack and at least a portion of the second castor is located directly beneath the second battery pack.

9. A self-propelled, dust-collecting robot, comprising:

a housing having an interior, a bottom wall, and a front wall portion spaced from a rear wall portion in a first direction;

a first drive wheel;

a second drive wheel spaced from the first drive wheel in a second direction perpendicular to the first direction, the first drive wheel and the second drive wheel being supported by the housing and being rotatable around a drive wheel axis of rotation;

a dust-collecting opening extending through the bottom wall between the drive wheel axis of rotation and the front wall portion;

a vacuum unit having a dust-collection motor in the interior connected to the dust-collecting opening and configured to draw dust into the dust-collecting opening;

a first castor and a second castor disposed between the drive wheel axis of rotation and the rear wall portion, each of the first and second castors respectively including a castor wheel rotatable about an axle axis of an axle and a support shaft attached to the housing and defining a pivot axis substantially perpendicular to the axle axis, each of the castor wheels being pivotable about the respective pivot axis;

a first power tool battery pack and a second power tool battery pack respectively mounted to the housing at locations between the drive wheel axis of rotation and the rear wall portion, wherein:

at least a portion of the first castor is located directly beneath the first power tool battery pack and at least a portion of the second castor is located directly beneath the second power tool battery pack, the first drive wheel is bounded by a first plane perpendicular to the drive wheel axis of rotation, the second drive wheel is bounded by a second plane perpendicular to the drive wheel axis of rotation, the pivot axis of the first castor and the pivot axis of the second castor are located between the first plane and the second plane, the first castor and the second castor are spaced from the dust-collecting opening in a direction opposite the first direction, the first castor is spaced from the second castor in the second direction, and the first battery pack and the second battery pack do not overlie the drive wheel axis of rotation when the first and second drive wheels and the first and second castors support the robot on a support surface.

10. The self-propelled, dust-collecting robot according to claim 9, wherein the first battery pack and the second battery pack are respectively mounted on first and second pairs of guide rails that extend on the housing in a third direction perpendicular to the first direction and to the second direction such that the first and second battery packs sandwich the dust-collection motor in the second direction and are removable from the guide rails in the third direction.

11. The self-propelled, dust-collecting robot according to claim 10, wherein:

the first battery pack includes a first side and a second side opposite the first side, the first side of the first battery pack includes an electrical connector in contact with an electrical connector of the first battery pack mount and the second side of the first battery pack is radially spaced from the first side of the first battery pack and is located at a periphery of the main body part.

12. The self-propelled, dust-collecting robot according to claim 10, wherein the electrical connector lies between the first and second guide rails.

13. The self-propelled, dust-collecting robot according to claim 12, wherein the first and second battery packs each include a case, at least one battery cell in the case, a control circuit board having a controller mounted in the case, and a discharge terminal.

14. The self-propelled, dust-collecting robot according to claim 12, wherein the first and second battery packs are externally mounted.

15. A self-propelled, dust-collecting robot, comprising:

a main-body part including a front wall portion spaced from a rear wall portion in a first direction;

a dust-collection unit provided on the main-body part;

a first drive wheel;

a second drive wheel spaced from the first drive wheel in a second direction perpendicular to the first direction, the first drive wheel and the second drive wheel being supported by the main-body part and being rotatable around a drive wheel axis of rotation;

first and second power tool battery packs externally mounted to the main-body part; and first and second castors provided in a lower part of the main-body part each of the first and second castors respectively including a castor wheel rotatable about an axle axis of an axle and a support shaft attached to the housing and defining a pivot axis substantially perpendicular to the axle axis, each of the castor wheels being pivotable about the respective pivot axis;

wherein:

the first and second castors are respectively disposed immediately below the first and second power tool battery packs, the first drive wheel is bounded by a first plane perpendicular to the drive wheel axis of rotation, the second drive wheel is bounded by a second plane perpendicular to the drive wheel axis of rotation, the pivot axis of the first castor and the pivot axis of the second castor are located between the first plane and the second plane, the first castor and the second castor are spaced from the dust-collecting opening in a direction opposite the first direction, the first castor is spaced from the second castor in the second direction, and the first battery pack and the second battery pack do not overlie the drive wheel axis of rotation when the first and second drive wheels and the first and second castors support the robot on a support surface.

16. The self-propelled, dust-collecting robot according to claim 15, wherein the first and second power tool battery packs each include a case, at least one battery cell in the case, a control circuit board having a controller mounted in the case, and a discharge terminal.

17. The self-propelled dust-collecting robot according to claim 15, wherein the main body part has an interior and a bottom wall;

wherein the dust-collecting robot further includes:

a dust-collecting opening extending through the bottom wall between the drive wheel axis of rotation and the front wall portion;

wherein the dust collecting unit includes a vacuum unit having a dust-collection motor in the interior and connected to the dust-collecting opening and configured to draw dust into the dust-collecting opening, and wherein the first and second castors are disposed between the drive wheel axis of rotation and the rear wall portion.

18. The self-propelled, dust-collecting robot according to claim 17, wherein the first and second power tool battery packs are respectively mounted on first and second pairs of guide rails that extend on the main body part in a third direction perpendicular to the first direction and to the second direction such that the first and second power tool battery packs sandwich the dust-collection motor in the second direction and are removable from the guide rails in the third direction.

19. The self-propelled, dust-collecting robot according to claim 17, further including a pair of electrical terminals between the respective pairs of guide rails.

20. The self-propelled dust-collecting robot according to claim 6, further including:

a third battery pack mount configured in a manner identical to the first battery pack mount;

a third battery pack connected to the third battery pack mount;

a fourth battery pack mount configured in a manner identical to the first battery pack mount; and a fourth battery pack connected to the fourth battery pack mount.

21. The self-propelled dust-collecting robot according to claim 9, further including:

a third power tool battery pack mounted to the housing; and a fourth power tool battery pack mounted to the housing.

22. The self-propelled dust-collecting robot according to claim 15, further including:

a third power tool battery pack mounted to the main-body part; and a fourth power tool battery pack mounted to the main-body part.

* * * * *